US009025981B2

(12) United States Patent
Yoshioka

(10) Patent No.: US 9,025,981 B2
(45) Date of Patent: May 5, 2015

(54) IMAGE FORMING APPARATUS

(71) Applicant: Fuji Xerox Co., Ltd., Tokyo (JP)

(72) Inventor: Tomoaki Yoshioka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/920,438

(22) Filed: Jun. 18, 2013

(65) Prior Publication Data

US 2014/0153945 A1 Jun. 5, 2014

(30) Foreign Application Priority Data

Nov. 30, 2012 (JP) ..... 2012-263168

(51) Int. Cl.
*G03G 15/16* (2006.01)
*G03G 15/01* (2006.01)
*G03G 21/16* (2006.01)

(52) U.S. Cl.
CPC ..... *G03G 15/1615* (2013.01); *G03G 15/0136* (2013.01); *G03G 21/168* (2013.01); *G03G 2215/0129* (2013.01); *G03G 2215/0193* (2013.01)

(58) Field of Classification Search
CPC ..... G03G 15/0136; G03G 15/1615; G03G 21/168; G03G 2215/0122; G03G 2215/0196
USPC ..... 399/66, 302, 308
See application file for complete search history.

(56) References Cited

U.S. PATENT DOCUMENTS 5,678,150 A * 10/1997 Takahashi et al. ..... 399/299
8,208,823 B2 * 6/2012 Yoshioka ..... 399/45
8,417,164 B2 * 4/2013 Ichihashi et al. ..... 399/302
2005/0152716 A1 * 7/2005 Agata et al. ..... 399/223
2005/0185991 A1 * 8/2005 Iwakura et al. ..... 399/299
2007/0286628 A1 * 12/2007 Kayahara et al. ..... 399/66
2008/0095556 A1 * 4/2008 Mochizuki ..... 399/308
2009/0097888 A1 * 4/2009 Hirai et al. ..... 399/308
2010/0008689 A1 * 1/2010 Iwasaki et al. ..... 399/66
2011/0249986 A1 * 10/2011 Nakano ..... 399/121
2011/0318069 A1 * 12/2011 Nishizawa ..... 399/308
2012/0057908 A1 * 3/2012 Meguro ..... 399/313
2012/0237260 A1 * 9/2012 Sengoku et al. ..... 399/162
2013/0061698 A1 * 3/2013 Izumi et al. ..... 74/55

(Continued)

FOREIGN PATENT DOCUMENTS

JP A-5-80634 4/1993
JP 2007033938 A * 2/2007

(Continued)

*Primary Examiner* — Ryan Walsh
(74) *Attorney, Agent, or Firm* — Oliff PLC

(57) ABSTRACT

An image forming apparatus includes plural image carriers, an intermediate transfer body, a contact and separation mechanism, a selection member, plural first transfer units, a second transfer unit, and an adjustment member. Each image carrier carries a toner image. The intermediate transfer body is disposed so as to be in contact with one or more image carriers. The contact and separation mechanism causes the intermediate transfer body to be in contact with or separated from the image carriers. The selection member selects a first contact state or a second contact state. Each first transfer unit forms a transfer electric field in a first transfer region to transfer a toner image onto the intermediate transfer body. The second transfer unit forms a transfer electric field in a second transfer region to transfer toner images onto a recording material. The adjustment member adjusts first transfer conditions.

10 Claims, 25 Drawing Sheets

(56) References Cited

U.S. PATENT DOCUMENTS

2013/0209117 A1* 8/2013 Ikeda ..... 399/50
2014/0147145 A1* 5/2014 Yoshioka ..... 399/66

FOREIGN PATENT DOCUMENTS

JP 2008304780 A * 12/2008
JP A-2010-164798 7/2010

* cited by examiner

FIG. 9

| IMAGE FORMATION MODE | FC MODE | MONOCHROME K MODE |
|---|---|---|
| FIRST TRANSFER LOAD P | $P_K > P_C \geq P_M \geq P_Y$ | $P_K > P_K$ (FC MODE) |
| FIRST TRANSFER CURRENT I | $I_K < I_C \leq I_M \leq I_Y$ | $I_K < I_K$ (FC MODE) |

FIG. 16A

| IMAGE FORMATION MODE | FC MODE | MONOCHROME K MODE |
|---|---|---|
| FIRST TRANSFER LOAD P | $P_C > P_M \geq P_Y \geq P_K$ | $P_K > P_K$ (FC MODE) |
| FIRST TRANSFER CURRENT I | $I_C < I_M \leq I_Y \leq I_K$ | $I_K < I_K$ (FC MODE) |

FIG. 16B

| IMAGE FORMATION MODE | FC MODE | MONOCHROME K MODE |
|---|---|---|
| FIRST TRANSFER LOAD P | $P_C \geq P_M \geq P_Y \geq P_K$ | $P_K > P_K$ (FC MODE) |
| FIRST TRANSFER CURRENT I | $I_C \leq I_M \leq I_Y \leq I_K$ | $I_K < I_K$ (FC MODE) |

| IMAGE FORMATION MODE | FC MODE | MONOCHROME K MODE |
|---|---|---|
| FIRST TRANSFER LOAD P | $P_K > P_C \geq P_M \geq P_Y$ | $P_K > P_K$ (FC MODE) |
| FIRST TRANSFER CURRENT I | $I_K < I_C \leq I_M \leq I_Y$ | $I_K < I_K$ (FC MODE) |

FIG. 25A

| IMAGE FORMATION MODE | FC MODE | EXTRA COLOR MODE | MONOCHROME K MODE |
|---|---|---|---|
| FIRST TRANSFER LOAD P | $P_C > P_M \geq P_Y \geq P_K \geq P_{X2} \geq P_{X1}$ | $P_{X2} > P_{X1} > P_{X1}$ (FC MODE) | $P_K > P_K$ (FC MODE) |
| FIRST TRANSFER CURRENT I | $I_C < I_M \leq I_Y \leq I_K \leq I_{X2} \leq I_{X1}$ | $I_{X2} < I_{X1} < I_{X1}$ (FC MODE) | $I_K < I_K$ (FC MODE) |

FIG. 25B

| IMAGE FORMATION MODE | FC MODE | EXTRA COLOR MODE | MONOCHROME K MODE |
|---|---|---|---|
| FIRST TRANSFER LOAD P | $P_C \geq P_M \geq P_Y \geq P_K \geq P_{X2} \geq P_{X1}$ | $P_{X2} > P_{X1} > P_{X1}$ (FC MODE) | $P_K > P_K$ (FC MODE) |
| FIRST TRANSFER CURRENT I | $I_C \leq I_M \leq I_Y \leq I_K \leq I_{X2} \leq I_{X1}$ | $I_{X2} < I_{X1} < I_{X1}$ (FC MODE) | $I_K < I_K$ (FC MODE) |

IMAGE FORMING APPARATUS

CROSS-REFERENCE TO RELATED APPLICATIONS

This application is based on and claims priority under 35 USC 119 from Japanese Patent Application No. 2012-263168 filed Nov. 30, 2012.

BACKGROUND

Technical Field

The present invention relates to an image forming apparatus.

SUMMARY

According to an aspect of the invention, there is provided an image forming apparatus including plural image carriers, an intermediate transfer body, a contact and separation mechanism, a selection member, plural first transfer units, a second transfer unit, and an adjustment member. Each of the plural image carriers carries a toner image that is formed thereon. The intermediate transfer body is rotated while facing the image carriers, is disposed so as to be in contact with one or more image carriers among the image carriers, and carries one or more toner images formed on the one or more image carriers. The contact and separation mechanism causes the intermediate transfer body to be in contact with or separated from the image carriers. The selection member selects, using the contact and separation mechanism, a first contact state in which all of the image carriers and the intermediate transfer body are in contact with each other or a second contact state in which one or some of the image carriers and the intermediate transfer body are in contact with each other. Each of the plural first transfer units includes a transfer member that corresponds to one image carrier among the image carriers and that is in contact with a back surface of the intermediate transfer body. Each of the plural first transfer units forms a transfer electric field in a first transfer region between the transfer member and the one image carrier to transfer a toner image onto the intermediate transfer body. The second transfer unit includes a transfer member disposed so as to face the intermediate transfer body and forms an electric field in a second transfer region between the transfer member and the intermediate transfer body to transfer toner images that have been transferred onto the intermediate transfer body onto a recording material. The adjustment member adjusts first transfer conditions for the first transfer units. The adjustment member includes a load adjustment unit that adjusts, in a case where the selection member selects the second contact state, for the first transfer unit corresponding to the image carrier located at the most downstream position in a movement direction of the intermediate transfer body among the one or more image carriers used for image formation, a load in the first transfer region of the transfer member that is in contact with the intermediate transfer body so that the load is set to be higher than in a case where the first contact state is selected, and so that, in a case where there is a first transfer unit located on an upstream side in the movement direction of the intermediate transfer body, the load is set to be higher than a load in the first transfer unit.

BRIEF DESCRIPTION OF THE DRAWINGS

Exemplary embodiments of the present invention will be described in detail based on the following figures, wherein:

FIG. 9 is an explanatory diagram illustrating first transfer conditions in individual image formation modes of the image forming apparatus according to the first exemplary embodiment;

FIG. 16A is an explanatory diagram illustrating first transfer conditions in individual image formation modes of the image forming apparatus according to the second exemplary embodiment;

FIG. 16B is an explanatory diagram illustrating first transfer conditions in individual image formation modes of the image forming apparatus according to a modification of the second exemplary embodiment;

FIG. 25A is an explanatory diagram illustrating first transfer conditions in individual image formation modes of the image forming apparatus according to the fifth exemplary embodiment; and FIG. 25B is an explanatory diagram illustrating first transfer conditions in individual image formation modes of an image forming apparatus according to a modification of the fifth exemplary embodiment.

DETAILED DESCRIPTION

Overview of Exemplary Embodiment

Figure 1:
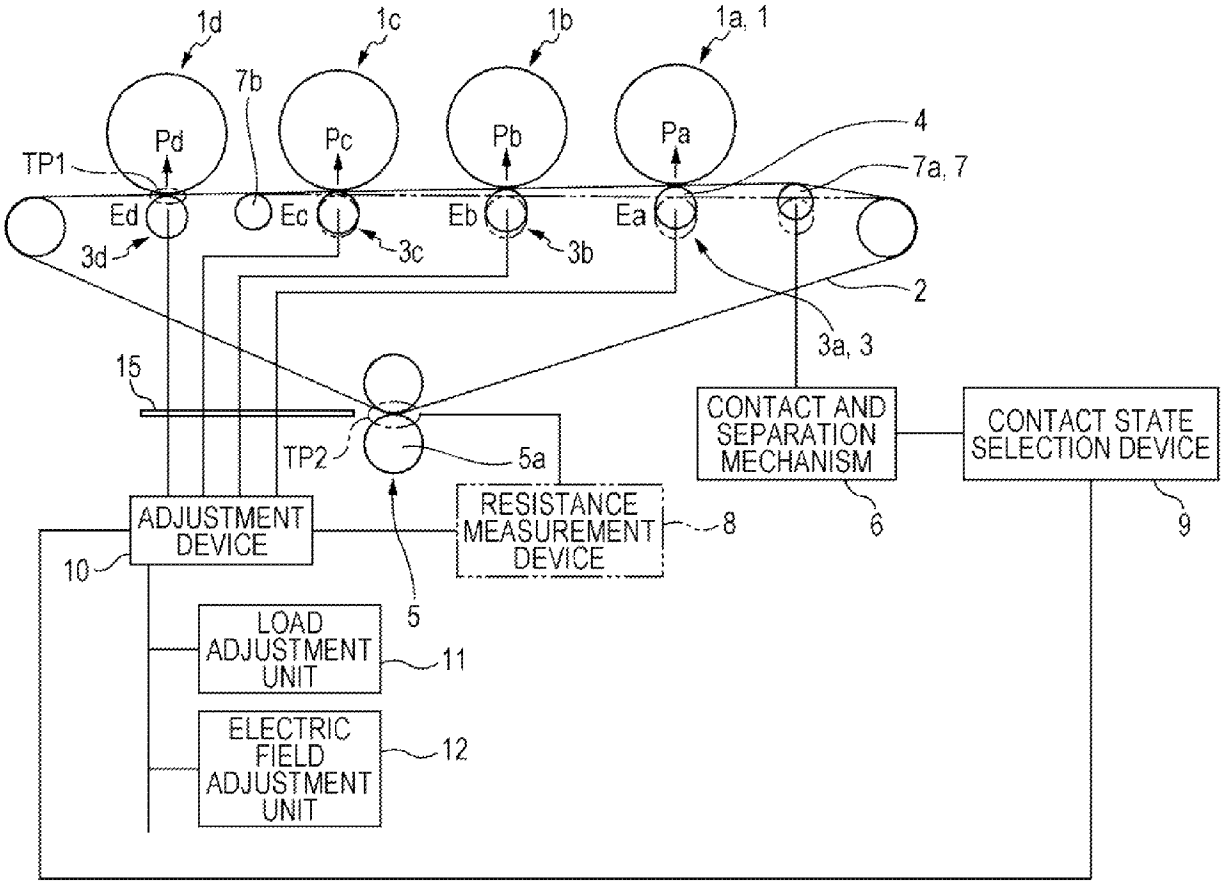
FIG. 1 is an explanatory diagram illustrating an overview of an image forming apparatus according to an exemplary embodiment of the present invention.

FIG. 1 illustrates an overview of an image forming apparatus according to an exemplary embodiment of the present invention.

Referring to FIG. 1, the image forming apparatus includes plural image carriers 1 (1*a* to 1*d* in this exemplary embodiment), an intermediate transfer body 2, a contact and separation mechanism 6, a contact state selection device 9, plural first transfer devices 3 (3*a* to 3*d* in this exemplary embodiment), a second transfer device 5, and an adjustment device 10. Each of the plural image carriers 1 carries a color component image that is formed thereon and is composed of a color component toner. The intermediate transfer body 2 is thin, is rotated while facing the plural image carriers 1, is disposed so as to be in contact with one or more image carriers 1 used for image formation among the plural image carriers 1, and temporarily carries one or more color component images formed on the one or more image carriers 1 before the one or more color component images are transferred onto a recoding material 15. The contact and separation mechanism 6 causes the intermediate transfer body 2 to be in contact with or separated from the plural image carriers 1 so that the one or more image carriers 1 used for image formation and the intermediate transfer body 2 are disposed so as to be in contact with each other and that one or more image carriers 1 not used for image formation among the plural image carriers 1 and the intermediate transfer body 2 are disposed so as to be separated from each other. The contact state selection device 9 selects, using the contact and separation mechanism 6, a full contact state in which all of the plural image carriers 1 and the intermediate transfer body 2 are disposed so as to be in contact with each other or a partial contact state in which one or some of the plural image carriers 1 and the intermediate transfer body 2 are disposed so as to be in contact with each other. Each of the plural first transfer devices 3 includes a transfer member 4 that corresponds to one image carrier 1 among the plural image carriers 1 and that is capable of being disposed so as to be in contact with a back surface of the intermediate transfer body 2. Each of the plural first transfer devices 3 forms a transfer electric field in a first transfer region TP1 between the transfer member 4 and the one image carrier 1 to transfer a color component image carried by the one image carrier 1 onto the intermediate transfer body 2. The second transfer device 5 includes a transfer member 5*a* disposed so as to face a front surface of the intermediate transfer body 2 and forms a transfer electric field in a second transfer region TP2 between the transfer member 5*a* and the intermediate transfer body 2 to transfer color component images that have been transferred onto the intermediate transfer body 2 by the plural first transfer devices 3 onto a recording material 15. The adjustment device 10 adjusts first transfer conditions for the plural first transfer devices 3. The adjustment device 10 includes a load adjustment unit 11. The load adjustment unit 11 adjusts, in a case where the contact state selection device 9 selects the partial contact state, for the first transfer device 3 corresponding to the image carrier 1 located at the most downstream position in a movement direction of the intermediate transfer body 2 among the one or more image carriers 1 used for image formation, a load in the first transfer region of the transfer member 4 that is in contact with the intermediate transfer body 2 so that the load is set to be higher than in a case where the full contact state is selected, and so that, in a case where there is a first transfer device 3 located on an upstream side in the movement direction of the intermediate transfer body 2, the load is set to be higher than a load in the first transfer device 3.

In FIG. 1, P (Pa to Pd) represent loads that are applied to the first transfer regions TP1 of the transfer members 4 of the first transfer devices 3 (3*a* to 3*d*), and E (Ea to Ed) represent transfer electric fields that act on the first transfer regions TP1 of the transfer members 4 of the first transfer devices 3 (3*a* to 3*d*).

In such a technical configuration, it is assumed that the image forming apparatus according to this exemplary embodiment is a so-called tandem-type image forming apparatus that includes plural image carriers 1 and that employs an intermediate transfer system.

Here, examples of the plural image carriers 1 may be photoconductors or dielectric materials, and are not limited as long as the image carriers 1 are capable of carrying images formed by developing electrostatic latent images of individual color components using toners. For example, pixel electrodes may be arranged in units of pixels in the vertical and horizontal directions, and an electrostatic latent image voltage may be applied to the pixel electrodes, so as to form electrostatic latent images. Further, the plural image carriers 1 include image carriers that carry images composed of extra color component toners (a transparent color, a special color, etc.), as well as image carriers that carry images composed of ordinarily used color component toners.

The arrangement order of the plural image carriers 1 may be appropriately set. For example, from the viewpoint of shortening the time of forming a monochrome image composed of a black toner, the image carrier 1 (1*d*) located at the most downstream position in the movement direction of the intermediate transfer body 2 among the plural image carriers 1 (for example, 1*a* to 1*d*) forms a black toner image, and is used for image formation and is disposed so as to be in contact with the intermediate transfer body 2 in any image formation state in which one or more image carriers 1 are used.

In this exemplary embodiment, the image carrier 1 at the most downstream position in the movement direction of the intermediate transfer body 2 forms a black toner image, and it is necessary that the image carrier 1 for a black toner image (for example, 1*d*) is always used for image formation and is disposed so as to be in contact with the intermediate transfer body 2 in any image formation mode, that is, a full-color (FC) mode, a monochrome black mode (monochrome K mode), or a two-color mode including black. Thus, for example, in a case where the monochrome K mode is selected as an image formation mode, the distance between the image carrier 1 (1*d*) at the most downstream position and the transfer region of the second transfer device 5 is shorter than in the other cases, and thus an image formation processing time for forming a black image may be shortened.

Furthermore, the intermediate transfer body 2 is disposed so as to be in contact with one or more image carriers 1 used for image formation among the plural image carriers 1. In the tandem-type image forming apparatus, the plural image carriers 1 (1*a* to 1*d* in this exemplary embodiment) may constantly be in contact with the intermediate transfer body 2 during image formation. In this exemplary embodiment, there is provided the contact and separation mechanism 6 that causes the intermediate transfer body 2 to be in contact with or separated from the one or more image carriers 1 used for image formation.

In this exemplary embodiment, the "intermediate transfer body 2 that is thin" may be an intermediate transfer belt or a thin-plate-shaped intermediate transfer drum.

The contact and separation mechanism 6 causes one or more image carriers 1 used for image formation and the intermediate transfer body 2 to be in contact with each other and causes the other image carriers 1 and the intermediate transfer body 2 to be separated from each other. The positions of the individual image carriers 1 may be fixed and the position of the intermediate transfer body 2 may be moved (for example, the intermediate transfer body 2 may be positioned using positioning members 7 (7*a* and 7*b* in this exemplary embodiment), and the position of the intermediate transfer body 2 may be moved by changing the position of the positioning member 7*a*), or the position of the intermediate transfer body 2 may be fixed and the positions of the individual image carriers 1 may be moved, or the positions of the individual image carriers 1 and the intermediate transfer body 2 may be moved. To precisely form images on the individual image carriers 1, the positions of the individual image carriers 1 may be fixed. Here, the partial contact state is not limited to one state, and may include plural states.

The contact state selection device 9 is not limited as long as it is capable of causing, using the contact and separation mechanism 6, the image carriers 1 and the intermediate transfer body 2 to be in contact with or separated from each other and selecting a full contact state in which all of the plural image carriers 1 and the intermediate transfer body 2 are disposed so as to be in contact with each other or a partial contact state in which one or some of the plural image carriers 1 used for image formation and the intermediate transfer body 2 are disposed so as to be in contact with each other, because the image carriers 1 used for image formation vary depending on the type of image formation.

Also, it is assumed that each of the first transfer devices 3 includes the transfer member 4 (for example, a transfer roller) that is in contact with the back surface of the intermediate transfer body 2. Thus, examples of the first transfer devices 3 do not include noncontact-type corotrons or the like.

The second transfer device 5 includes the transfer member 5*a* that faces the front surface of the intermediate transfer body 2. As long as the second transfer device 5 is capable of transferring individual color component images on the intermediate transfer body 2 onto the recording material 15, the transfer member 5*a* may be of a contact type in which the transfer member 5*a* comes into contact with the intermediate transfer body 2 (a transfer roller system or a transfer belt system), or a noncontact type in which the transfer member 5*a* does not come into contact with the intermediate transfer body 2 (corotron or the like).

The adjustment device 10 adjusts, when the full contact state or the partial contact state is selected by the contact and separation mechanism 6, the first transfer condition for the first transfer device 3 corresponding to the image carrier 1 located at the most downstream position in the movement direction of the intermediate transfer body 2 among one or more image carriers 1 used for image formation.

Here, the first transfer condition includes a load in the first transfer region TP1 of the transfer member 4. The adjustment device 10 includes a functional unit (the load adjustment unit 11) that adjusts, in the partial contact state (for example, a state in which the image carrier 1*d* is in contact with the intermediate transfer body 2), a load Pd in the first transfer region TP1 of the transfer member 4 corresponding to the image carrier 1 at the most downstream position (1*d* in this exemplary embodiment) so that the load Pd is set to be higher than in the full contact state. However, in this exemplary embodiment, one image carrier 1*d* is in contact with the intermediate transfer body 2 in the partial contact state, and thus no image carriers 1 used for image formation exist on the upstream side of the image carrier 1*d* in the partial contact state. In a case where plural image carriers 1 (for example, 1*c* and 1*d*) are in contact with the intermediate transfer body 2 in the partial contact state, the load adjustment unit 11 may include a functional unit that adjusts the load Pd in the first transfer region TP1 of the transfer member 4 corresponding to the image carrier 1*d* at the most downstream position to be higher than a load in the first transfer device 3 corresponding to the image carrier 1 (1*c* in this exemplary embodiment) located on the upstream side.

In the full contact state, all the image carriers 1 are disposed so as to be in contact with the intermediate transfer body 2, and thus the individual transfer members 4 may be disposed so as to be in contact with the intermediate transfer body 2 with predetermined loads P in the first transfer regions TP1. In contrast, in the partial contact state, the number of image carriers 1 that are in contact with the intermediate transfer body 2 is smaller than in the full contact state. Thus, in the partial contact state, for at least the first transfer device 3 (for example, 3*d*) located at the most downstream position in the movement direction of the intermediate transfer body 2, the load P (for example, Pd) in the first transfer region TP1 of the transfer member 4 is set to be high, thereby an image passing through the first transfer region TP1 of the image carrier 1 at the most downstream position (for example, 1*d*) is compressed with a higher pressure. Accordingly, toner coheres and cohesion of the image increases.

In a case where plural image carriers 1 are in contact with the intermediate transfer body 2 in the partial contact state, it is necessary that, for the first transfer device 3 located at the most downstream position (for example, 3*d*), the load P (for example, Pd) in the first transfer region TP1 of the transfer member 4 is set to be higher than a load in the upstream side. This is because, if the load P in the first transfer region TP1 of the transfer member 4 on the upstream side is set to be equal to or higher than the load P at the most downstream position, an image composed of a color component toner on the upstream side may be compressed more than necessary when the image passes through the first transfer region TP1 at the most downstream position.

In a case where a partial contact state is selected in which plural image carriers 1 are in contact with the intermediate transfer body 2, the transfer condition for the first transfer device 3 corresponding to an image carrier 1 other than the image carrier 1 located at the most downstream position may be appropriately set as long as the load P in the first transfer device 3 is lower than the load P in the first transfer region TP1 of the transfer member 4 of the first transfer device 3 corresponding to the image carrier 1 at the most downstream position.

Next, the operation of the image forming apparatus according to this exemplary embodiment will be described.

First, the operation of an image forming apparatus according to a comparative embodiment will be described to evaluate the performance of the image forming apparatus according to this exemplary embodiment.

The basic configuration of the image forming apparatus according to the comparative embodiment includes, substantially similarly to the above-described exemplary embodiment, plural image carriers 1 (for example, 1*a* to 1*d*), an intermediate transfer body 2, plural first transfer devices 3 (for example, 3*a* to 3*d*), and a second transfer device 5. Note that first transfer conditions are set so that the loads P in first transfer regions TP1 are equivalent to one another in the full contact state and the partial contact state.

Figure 2A:
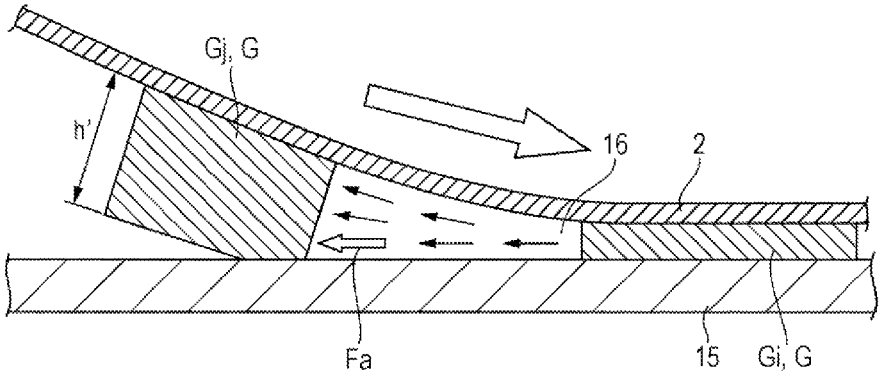
FIG. 2A is an explanatory diagram schematically illustrating an image transfer state in a second transfer region of an image forming apparatus according to a comparative embodiment.

In the image forming apparatus according to the comparative embodiment, it is assumed that line images G (for example, Gi and Gj), which are plural linear images extending in the width direction that intersects with the movement direction of the intermediate transfer body 2, are formed at a certain interval in the movement direction of the intermediate transfer body 2. For example, in a case where the partial contact state is selected, as illustrated in FIG. 2A, when the line images G (Gi and Gj) on the intermediate transfer body 2 reach the second transfer region TP2 of the second transfer device 5, a phenomenon occurs in which a portion of the line images G in the image transferred onto the recording material 15 scatters. Such a scattering phenomenon of the line images G is estimated to occur for the following reason. When the line images G (Gi and Gj) on the intermediate transfer body 2 are pressed to be in contact with the recording material 15 in the second transfer region TP2, the air in a gap 16 between the line images G (Gi and Gj) is compressed, a fluid force Fa generated by the compressed air in the gap 16 is applied to the line image G (Gj) located on the upstream side in the movement direction of the intermediate transfer body 2, and toner scattering occurs in a portion of the line image Gj.

In particular, such scattering of the line images G is expected to be remarkable in the following case: in the case of forming single-color or multi-color line images G using one or plural image carriers 1 (for example, 1*c* and 1*d*) located on the downstream side in the movement direction of the intermediate transfer body 2 among the image carriers 1 that are necessary for image formation, the number of passages through the first transfer regions TP1 of the transfer members 4 of the first transfer devices 3 is small compared to single-color or multi-color line images G formed on the image carriers 1 (for example, 1*a* and 1*b*) located on the upstream side in the movement direction of the intermediate transfer body 2, and accordingly the toner cohesion of the line images G is small.

Thus, in the partial contact state in which one or some of the plural image carriers 1 are disposed so as to be in contact with the intermediate transfer body 2, the number of passages through the first transfer regions TP1 is smaller than in the full contact state in which all of the plural image carriers 1 are disposed so as to be in contact with the intermediate transfer body 2, and thus the above-described scattering of the line images G is more likely to occur.

To prevent such scattering of the line images G, the toner cohesion of the line images G formed on the recording material 15 may be increased with respect to the fluid force Fa generated by the compressed air in the gap 16 between the line images G, so that the toner in the line images G is less likely to scatter.

Figure 2B:
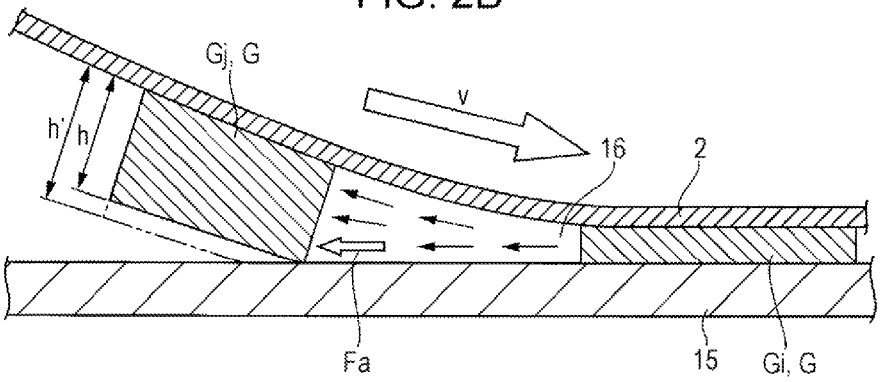
FIG. 2B is an explanatory diagram schematically illustrating an image transfer state in a second transfer region of the image forming apparatus according to the exemplary embodiment.

The image forming apparatus according to this exemplary embodiment is configured by embodying the above-described conception. As illustrated in FIG. 2B, in a case where the partial contact state is selected, the load Pd in the first transfer region TP1 of the first transfer device 3 (for example, 3*d*) corresponding to the image carrier 1 (for example, 1*d*) located at the most downstream position in the movement direction of the intermediate transfer body 2 among the image carriers 1 used for image formation is adjusted so that the load Pd is set to be higher than in the full contact state, and so that, if there is a first transfer device 3 located on the upstream side, the load Pd is set to be higher than the load in the first transfer device 3. Accordingly, in the partial contact state, when the line images G as a first transfer image pass through the first transfer region TP1 of the first transfer device 3 corresponding to the image carrier 1 located at the most downstream position, the line images G are compressed with higher pressure than in the image forming apparatus according to the comparative embodiment, the layer thickness h of the line images G is smaller than the layer thickness h' in the comparative embodiment accordingly, and the toner cohesion of the line images G increases. When such a first transfer image (line images G) reaches the second transfer region TP2, the first transfer image is second transferred onto the recording material 15, and the image is held on the recording material 15 with an electrostatic adhesion force and a non-electrostatic adhesion force. Since the toner cohesion of the line images G is increased, scattering is less likely to occur in the line images G compared to the comparative embodiment, even if the fluid force Fa generated by the compressed air in the gap 16 between the line images G (Gi and Gj) acts on one of the line images G (for example, Gj).

Next, a representative mode of the image forming apparatus according to this exemplary embodiment will be described.

The adjustment device 10 may include a load adjustment unit 11. The load adjustment unit 11 adjusts, in a case where the contact state selection device 9 selects the partial contact state, for the first transfer device 3 corresponding to an image carrier 1 other than the image carrier 1 located at the most downstream position in the movement direction of the intermediate transfer body 2 among the one or more image carriers 1 used for image formation, a load P in the first transfer region TP1 of the transfer member 4 that is in contact with the intermediate transfer body 2 so that the load P is set to be equal to or higher than in a case where the full contact state is selected.

This mode defines the transfer condition for the first transfer device 3 corresponding to an image carrier 1 other than the image carrier 1 located at the most downstream position.

In this mode, for example, it is assumed that plural image carries 1 (1*c* and 1*d*) are disposed so as to be in contact with the intermediate transfer body 2 in the partial contact state. When the load Pc in the first transfer region TP1 of the transfer member 4 of the first transfer device 3 corresponding to the image carrier 1 (for example, 1*c*) other than the image carrier 1 at the most downstream position is represented by P1, and when the load Pc in the first transfer region TP1 in the full contact state is represented by P0, P1≥P0 is satisfied. Thus, the load P1 in the first transfer region TP1 of the first transfer device 3 corresponding to the image carrier 1 other than the image carrier 1 at the most downstream position may be equal to P0 or may be higher than P0.

The adjustment device 10 may include an electric field adjustment unit 12 that adjusts, in a case where the contact state selection device 9 selects the partial contact state, for the first transfer device 3 (for example, 3*d*) corresponding to the image carrier 1 (for example, 1*d*) located at the most downstream position in the movement direction of the intermediate transfer body 2 among the one or more image carriers 1 used for image formation, a transfer electric field E (Ed) that acts on the first transfer region TP1 of the transfer member 4 of the first transfer device 3 (3*d*) so that the transfer electric field Ed is set to be lower than in a case where the full contact state is selected, and so that, in a case where there is a first transfer device 3 located on an upstream side in the movement direction of the intermediate transfer body 2, the transfer electric field Ed is set to be lower than a transfer electric field E in the first transfer device 3. The electric field adjustment unit 12 is not limited as long as it is capable of adjusting the transfer electric field E that acts on the first transfer region TP1, and may appropriately adjust a first transfer current supplied to the first transfer region TP1 or a first transfer voltage applied to the first transfer region TP1 when adjusting the transfer electric field E.

In this mode, the transfer electric field E that acts on the first transfer region TP1 is adjusted in addition to the load P in the first transfer region TP1, as a first transfer condition.

If a first transfer load is increased by the adjustment device 10, the contact width (nip width) of the first transfer region TP1 increases and the resistance in the transfer region decreases. Accordingly, at the time of first transfer, a larger amount of charge is discharged than in a case where the load P in the first transfer region TP1 is low, and image irregularities are more likely to occur. Furthermore, individual color component images that are formed on the image carriers 1 (for example, 1*a* to 1*c*) on the upstream side of the image carrier 1 (for example, 1*d*) at the most downstream position receive a large amount of discharge when passing through the first transfer region TP1 of the image carrier 1 (for example, 1*d*) at the most downstream position, compared to a case where the load P in the first transfer region TP1 is low. Receiving more charge injection than in a case where the load P in the first transfer region TP1 is low causes toner to be charged more than necessary. As result, a second transfer electric field in the second transfer device 5 becomes insufficient, and image density may be decreased.

Therefore, in this mode, to suppress unnecessary discharging or unnecessary charge injection, the load P (Pd) in the first transfer region TP1 of the transfer member 4 of the first transfer device 3 (for example, 3*d*) corresponding to the image carrier 1 (for example, 1*d*) at the most downstream position is adjusted to be high, and the transfer electric field E (for example, Ed) that acts on the first transfer region TP1 is adjusted to be low, so as to suppress image irregularities and a decrease in density.

At this time, it is necessary to adjust the transfer electric field E that acts on the first transfer region TP1 of the first transfer device 3 (for example, 3*d*) to be lower than in a case where the full contact state is selected. Furthermore, in a case where there is a first transfer device 3 on the upstream side (for example, 3*c*), it is necessary to adjust the transfer electric field E to be lower than that in the first transfer device 3 (3*c*). If the transfer electric field E is adjusted to be equal to or higher than that in the first transfer device 3 on the upstream side, an image composed of a color component toner on the upstream side may be unnecessarily charged.

Adjusting the transfer electric filed E (Ed) in the first transfer region TP1 of the first transfer device 3 (for example, 3*d*) to be low seems to result in a decrease in density. However, an increased load P in the first transfer region TP1 causes a decrease in effective resistance in the first transfer region TP1. Accordingly, in view of the total transfer performance in the second transfer region TP2, including the charging balance of individual color component toners adjusted by suppressing unnecessary discharging, first transfer efficiency slightly decreases but second transfer efficiency slightly increases because discharging is suppressed, and a decrease in density of an image transferred in the second transfer region TP2 is prevented.

The adjustment device 10 may include an electric field adjustment unit 12 that adjusts, in a case where the contact state selection device 9 selects the partial contact state, for the first transfer device 3 (for example, 3*c*) corresponding to an image carrier 1 (for example, 1*c*) other than the image carrier 1 (for example, 1*d*) located at the most downstream position in the movement direction of the intermediate transfer body 2 among the one or more image carriers 1 used for image formation, a transfer electric field E (for example, Ec) that acts on the first transfer region TP1 of the transfer member 4 of the first transfer device 3 so that the transfer electric field Ec is set to be equal to or lower than in a case where the full contact state is selected.

In this mode, it is assumed that, in a case where the partial contact state is selected, plural image carriers 1 (for example, 1*c* and 1*d*) are disposed so as to be in contact with the intermediate transfer body 2, and the transfer electric field E that acts on the first transfer region TP1 of the first transfer device 3 corresponding to the image carrier 1 (for example, 1*c*) other than the image carrier 1 (for example, 1*d*) located at the most downstream position is adjusted.

In this mode, when the electric field Ec that acts on the first transfer region TP1 of the transfer member 4 of the first transfer device 3 (3*c*) corresponding to the image carrier 1 (for example, 1*c*) other than the image carrier 1 (1*d*) at the most downstream position is represented by E1, and when the electric field Ec that acts on the first transfer region TP1 in the full contact state is represented by E0, E1≤E0 is satisfied. Thus, the transfer electric field E1 that acts on the first transfer region TP1 of the first transfer device 3 corresponding to the image carrier 1 other than the image carrier 1 at the most downstream position may be equal to E0 or may be lower than E0.

Furthermore, the image forming apparatus may further include a resistance measurement device 8 that is capable of measuring a combined resistance in the second transfer region TP2 of the second transfer device 5. The adjustment device 10 may include an electric field adjustment unit 12 that adjusts, for one or more first transfer devices 3 corresponding to the one or more image carriers 1 used for image formation, in accordance with the combined resistance in the second transfer region TP2 measured by the resistance measurement device 8, a transfer electric field E that acts on the first transfer region TP1 of the transfer member 4 that is in contact with the intermediate transfer body 2 so that the transfer electric field E becomes higher when the combined resistance is changed to be decreased.

Here, the resistance measurement device 8 measures a combined resistance in the second transfer region TP2 (constituted by the transfer member, the intermediate transfer body, and an opposed member) of the second transfer device 5. If the combined resistance in the second transfer region TP2 changes in accordance with a usage history or change in environment, a second transfer condition changes. This mode is directed to reflecting such a change in the second transfer condition in adjustment of a first transfer condition.

Hereinafter, exemplary embodiments of the present invention will be described in detail with reference to the attached drawings.

First Exemplary Embodiment

Entire Configuration of Image Forming Apparatus

Figure 3:
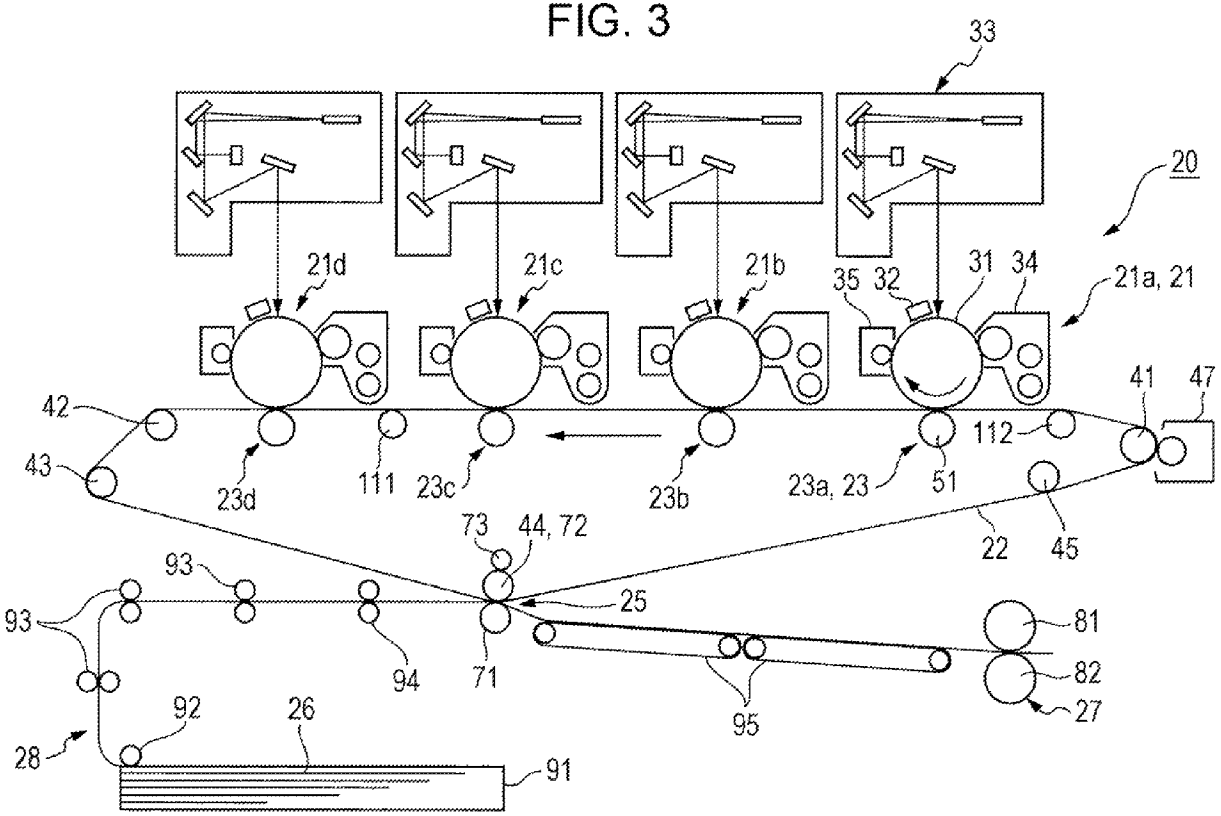
FIG. 3 is an explanatory diagram illustrating the entire configuration of an image forming apparatus according to a first exemplary embodiment.

FIG. 3 is an explanatory diagram illustrating the entire configuration of an image forming apparatus 20 according to a first exemplary embodiment.

Referring to FIG. 3, the image forming apparatus 20 is of a so-called tandem type and employs an intermediate transfer system, and includes image forming units 21 (specifically, 21*a* to 21*d*) for plural color components (yellow (Y), magenta (M), cyan (C), and black (K) in this exemplary embodiment), a belt-shaped intermediate transfer body 22, first transfer devices 23 (specifically, 23*a* to 23*d*), and a second transfer device 25. The image forming units 21 are arranged in a lateral direction along a substantially horizontal direction. The intermediate transfer body 22 is rotatably disposed at a position facing the individual image forming units 21. On the back surface of the intermediate transfer body 22, the first transfer devices 23 (specifically, 23*a* to 23*d*), which first transfer images formed by the individual image forming units 21 using individual color component toners onto the intermediate transfer body 22, are disposed at the positions corresponding to the individual image forming units 21. The second transfer device 25, which second transfers (collectively transfers) individual color component images that have been first transferred onto the intermediate transfer body 22 onto a recording material 26, is disposed at a portion of the intermediate transfer body 22 located on the downstream side of the image forming unit 21 (21*d* in this exemplary embodiment) that is located at the most downstream position in the movement direction of the intermediate transfer body 22.

Further, the image forming apparatus 20 according to this exemplary embodiment includes a fixing device 27 that fixes images that have been collectively transferred by the second transfer device 25 onto the recording material 26, and a recording material transport system 28 that transports the recording material 26 to a transfer position of the second transfer device 25 and a fixing position of the fixing device 27.

In the first exemplary embodiment, each of the image forming units 21 (21*a* to 21*d*) includes a drum-shaped photoconductor 31. Around the photoconductor 31, there are provided a charging device 32 that causes the photoconductor 31 to be charged, such as a corotron, an exposure device 33 such as a laser scanning device that forms an electrostatic latent image on the charged photoconductor 31, a developing device 34 that develops the electrostatic latent image formed on the photoconductor 31 using a corresponding color component toner, and a cleaning device 35 that removes residual toner from the photoconductor 31.

The intermediate transfer body 22 is disposed around plural (five in this exemplary embodiment) tension rollers 41 to 45. The tension roller 41 is used as a drive roller driven by a driving motor (not illustrated). The tension rollers 42 to 45 are used as driven rollers. The tension roller 43 is used as a correction roller for correcting meander in a width direction that substantially intersects with the movement direction of the intermediate transfer body 22. The tension roller 44 is used as an opposed roller of the second transfer device 25. Further, a cleaning device 47 for removing residual toner from the intermediate transfer body 22 after a second transfer process is provided on the front surface of the intermediate transfer body 22 at a position opposed to the tension roller 41.

In the first exemplary embodiment, each of the first transfer devices 23 includes a first transfer roller 51 that corresponds to one of the photoconductors 31 and that is disposed so as to be in contact with the back surface of the intermediate transfer body 22. Pressing the first transfer roller 51 against the corresponding photoconductor 31 with a predetermined load forms a contact region (nip region) serving as a first transfer region TP1 between the photoconductor 31 and the intermediate transfer body 22. Further, supplying a predetermined first transfer current to the first transfer roller 51 causes a first transfer electric field to act on the first transfer region TP1 and causes an image composed of a color component toner on the photoconductor 31 to be transferred onto the intermediate transfer body 22.

Figure 4:
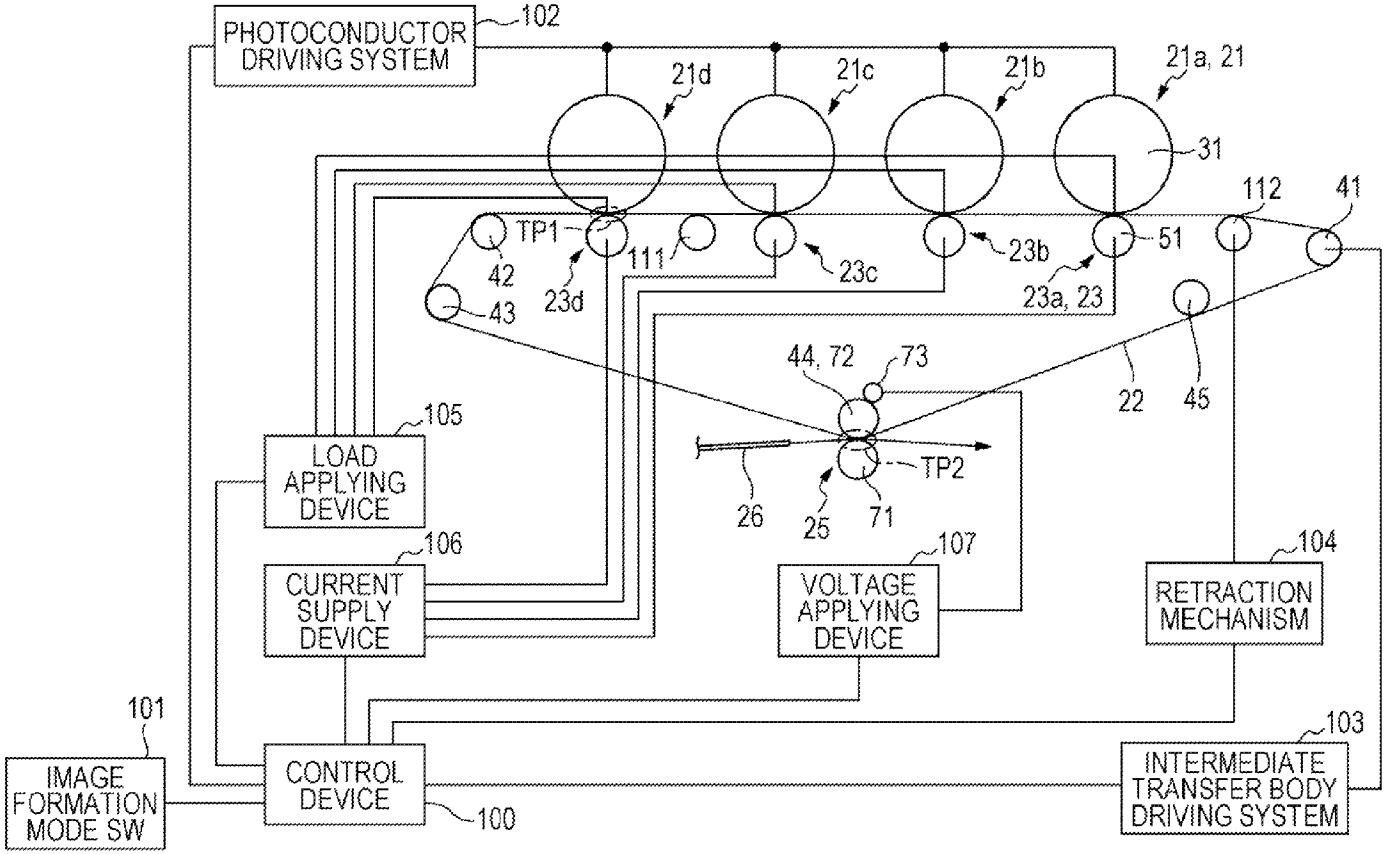
FIG. 4 is an explanatory diagram illustrating a drive control system of the image forming apparatus according to the first exemplary embodiment.
Figure 10A:
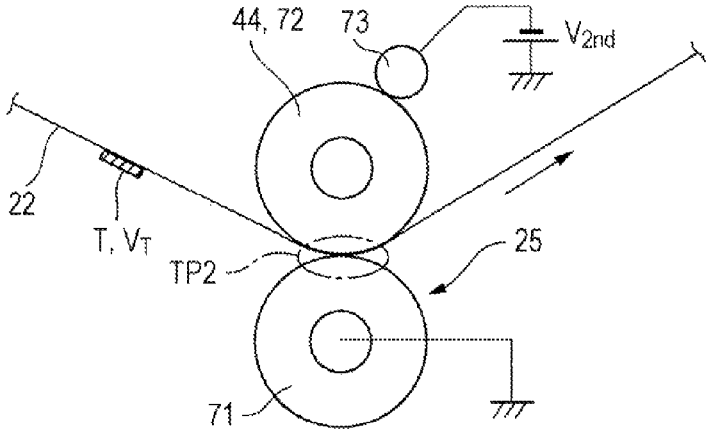
FIG. 10A is an explanatory diagram illustrating the details of a second transfer device used in the first exemplary embodiment.

As illustrated in FIGS. 3, 4, and 10A, the second transfer device 25 includes a second transfer roller 71 that is disposed so as to be in contact with the front surface of the intermediate transfer body 22 at the position corresponding to the tension roller 44. A contact region (nip region) serving as a second transfer region TP2 is formed between the second transfer roller 71 and the intermediate transfer body 22. A power feed roller 73 is disposed so as to be in contact with the front surface of the tension roller 44 serving as an opposed roller 72 of the second transfer roller 71. Applying a predetermined second transfer voltage to the power feed roller 73 and making the second transfer roller 71 grounded causes a second transfer electric field to act on the second transfer region TP2 and causes an image composed of individual color component toners on the intermediate transfer body 22 to be transferred onto the recording material 26.

The fixing device 27 includes, for example, a heating and fixing roller 81 that includes a heat source therein, and a pressing and fixing roller 82 that is disposed so as to be pressed against the heating and fixing roller 81 and that is rotated along with the heating and fixing roller 81. An unfixed image on the recording material 26 is heated, pressed, and fixed between the heating and fixing roller 81 and the pressing and fixing roller 82.

The recording material transport system 28 feeds the recording material 26 contained in a recording material container 91 to a recording material transport path using a feed roller 92. An appropriate number of transport rollers 93 are disposed along the recording material transport path. Also, positioning rollers 94 are disposed at positions just before the second transfer region along the recording material transport path. With the positioning rollers 94, the recording material 26 is supplied to the second transfer region at a certain timing after being positioned. Further, on the downstream side of the second transfer region along the recording material transport path, transport belts 95 capable of transporting the recording material 26 toward the fixing device 27 are disposed.

The recording material 26 that has passed through the fixing device 27 is output to a recording material output tray (not illustrated) via, for example, an output roller (not illustrated).

Drive Control System of Image Forming Apparatus

FIG. 4 illustrates a drive control system of the image forming apparatus 20 according to the first exemplary embodiment.

Referring to FIG. 4, a control device 100 controls an image formation process performed by the image forming apparatus 20. The control device 100 is constituted by a microcomputer including a central processing unit (CPU), a read only memory (ROM), a random access memory (RAM), an input/output interface, and so forth. The control device 100 receives an input signal from a start switch (not illustrated) or an image formation mode switch (SW) 101, which is a switch for selecting an image formation mode, via the input/output interface, executes an image formation control process program (see FIG. 7) that is stored in the ROM in advance using the CPU, generates control signals for targets of drive control, and transmits the control signals to the targets.

Here, examples of the targets of drive control include, in FIG. 4, a photoconductor driving system 102, an intermediate transfer body driving system 103, a retraction mechanism 104, a load applying device 105, a current supply device 106, and a voltage applying device 107. The photoconductor driving system 102 drives the photoconductors 31 of the individual image forming units 21 (21*a* to 21*d*). The intermediate transfer body driving system 103 drives and rotates the intermediate transfer body 22 by driving and rotating the tension roller 41 serving as a drive roller. The retraction mechanism 104 causes the intermediate transfer body 22 to be in contact with or separated from the photoconductors 31 of the individual image forming units 21 (21*a* to 21*d*). The load applying device 105 applies loads to the first transfer rollers 51 of the first transfer devices 23 corresponding to the individual image forming units 21. The current supply device 106 supplies first transfer currents to the first transfer rollers 51. The voltage applying device 107 applies a second transfer voltage to the power feed roller 73 of the second transfer device 25.

Retraction Mechanism

Figure 5A:
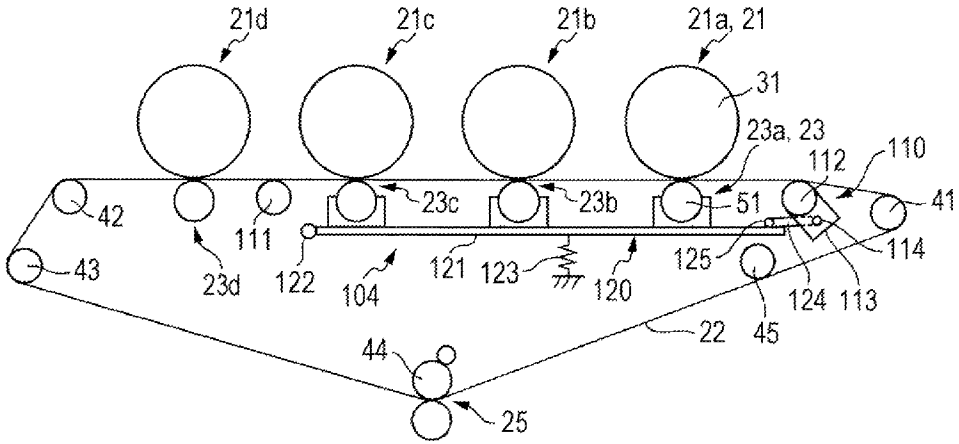
FIG. 5A is an explanatory diagram illustrating a retraction mechanism for an intermediate transfer body used in the first exemplary embodiment.
Figure 5B:
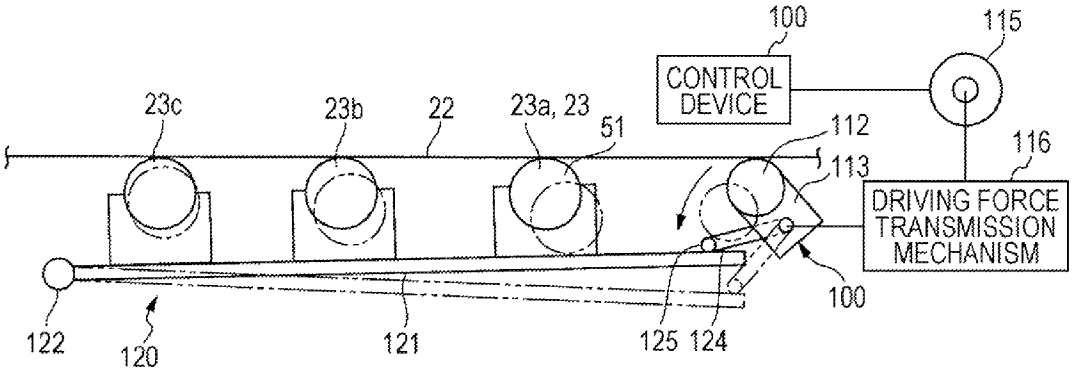
FIG. 5B is an explanatory diagram illustrating an operation state of the retraction mechanism.

FIGS. 5A and 5B illustrate the details of the retraction mechanism 104 according to the first exemplary embodiment.

Referring to FIGS. 5A and 5B, the retraction mechanism 104 causes the intermediate transfer body 22 to be in contact with or separated from the photoconductors 31 of the image forming units 21*a* to 21*c*, other than the image forming unit 21*d* located at the most downstream position in the movement direction of the intermediate transfer body 22, among the plural image forming units 21. In this exemplary embodiment, when the intermediate transfer body 22 is retracted from the photoconductors 31 of the individual image forming units 21*a* to 21*c*, the first transfer rollers 51 of the first transfer devices 23 corresponding to the individual image forming units 21*a* to 21*c* are retracted so as to be separated from the intermediate transfer body 22.

That is, the retraction mechanism 104 includes an intermediate transfer body contact and separation mechanism 110 that causes the intermediate transfer body 22 to be in contact with or separated from the photoconductors 31 of plural image forming units 21 (21*a* to 21*c* in this exemplary embodiment), and an interlock mechanism 120 that causes the intermediate transfer body 22 to be in contact with or separated from the first transfer devices 23 (23*a* to 23*c* in this exemplary embodiment) corresponding to the image forming units 21 (21*a* to 21*c*) in conjunction with the intermediate transfer body contact and separation mechanism 110.

Here, the intermediate transfer body contact and separation mechanism 110 includes a fixed positioning roller 111, a movable positioning roller 112, a swing table 113, and a swing fulcrum 114. The fixed positioning roller 111 is set in advance in a fixed manner as a movement trail position of the intermediate transfer body 22 on the back surface of the intermediate transfer body 22 between the image forming units 21*c* and 21*d*. The movable positioning roller 112 is set in a movable manner as a movement control position of the intermediate transfer body 22 on the back surface of the intermediate transfer body 22 at a position on the upstream side of the image forming unit 21*a* that is located at the most upstream position in the movement direction of the intermediate transfer body 22. The movable positioning roller 112 is supported by the swing table 113 that is swingable about the swing fulcrum 114.

As illustrated in FIG. 5B, the driving system of the intermediate transfer body contact and separation mechanism 110 includes a driving motor 115 that starts driving in response to a control signal from the control device 100. A driving force from the driving motor 115 is transmitted to the swing fulcrum 114 of the swing table 113 via a driving force transmission mechanism 116 including a gear, belt, and so forth.

The interlock mechanism 120 includes a swing plate 121 that is swingable about a swing fulcrum 122 inside the intermediate transfer body 22. The swing fulcrum 122 is set at a position corresponding to an intermediate position between the image forming units 21*c* and 21*d*. The first transfer devices 23*a* to 23*c* are disposed in a fixed manner on the swing plate 121. The swing plate 121 is urged by an urging spring 123 toward the intermediate transfer body 22. Further, a rotary member 124 that rotates in accordance with swinging of the swing table 113 is provided to the swing fulcrum 114 of the swing table 113 of the intermediate transfer body contact and separation mechanism 110. A holding piece 125 is provided at a portion separated from the swing fulcrum 114 of the rotary member 124, so that a swing free end of the swing plate 121 is held by the holding piece 125.

In the retraction mechanism 104, to achieve a full contact state in which the intermediate transfer body 22 is disposed so as to be in contact with the photoconductors 31 of all the image forming units 21 (21*a* to 21*d*), for example, the movable positioning roller 112 of the intermediate transfer body contact and separation mechanism 110 may be moved to a forward position represented by a solid line, as illustrated in FIG. 5B.

At this time, the intermediate transfer body 22 corresponding to the image forming units 21*a* to 21*c* is positioned by the fixed positioning roller 111 and the movable positioning roller 112. The photoconductors 31 of the individual image forming units 21 (21*a* to 21*c*) are disposed so as to be in contact with the intermediate transfer body 22, and also the first transfer rollers 51 of the first transfer devices 23 (23*a* to 23*c*) corresponding to the individual image forming units 21 (21*a* to 21*c*) are disposed so as to be in contact with the intermediate transfer body 22.

To achieve a partial contact state in which the intermediate transfer body 22 is disposed so as not to be in contact with the photoconductors 31 of the image forming units 21 (21*a* to 21*c*) other than the image forming unit 21*d* at the most downstream position, the movable positioning roller 112 of the intermediate transfer body contact and separation mechanism 110 may be moved to a backward position represented by a chained line, as illustrated in FIG. 5B.

At this time, the intermediate transfer body 22 corresponding to the image forming units 21 (21*a* to 21*c*) is positioned by the fixed positioning roller 111 and the tension roller 41. The photoconductors 31 of the individual image forming units 21 (21*a* to 21*c*) are disposed so as not to be in contact with the intermediate transfer body 22, and the intermediate transfer body 22 is disposed so as not to be in contact with the movable positioning roller 112 moved to the backward position. Further, as illustrated in FIG. 5B, with the movement of the movable positioning roller 112 to the backward position, the rotary member 124 of the interlock mechanism 120 moves to the position represented by a chained line, and causes the swing plate 121 to swing about the swing fulcrum 122 via the holding piece 125 to press down the swing plate 121. Accordingly, the individual first transfer devices 23 (23*a* to 23*c* in this exemplary embodiment) disposed on the swing plate 121 are disposed so as not to be in contact with the intermediate transfer body 22.

Load Applying Device

Figure 6B:
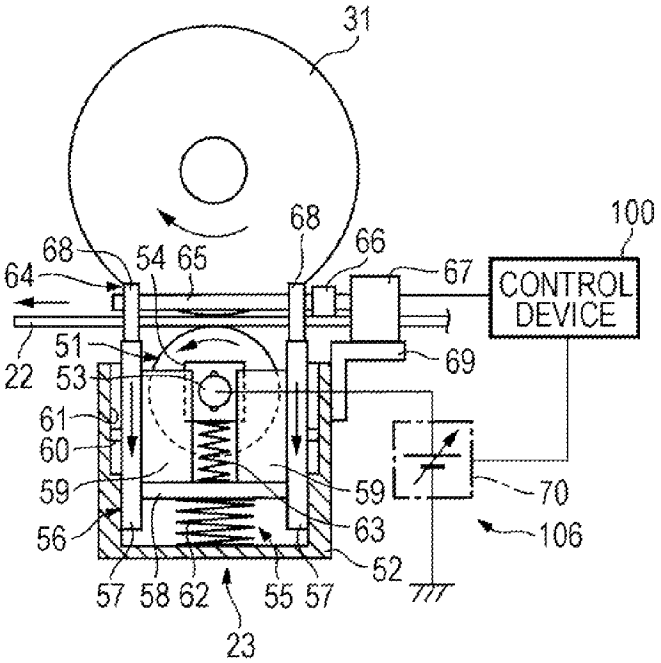
FIG. 6B is a plan view of FIG. 6A as seen in the direction of arrow VIB.
Figure 6A:
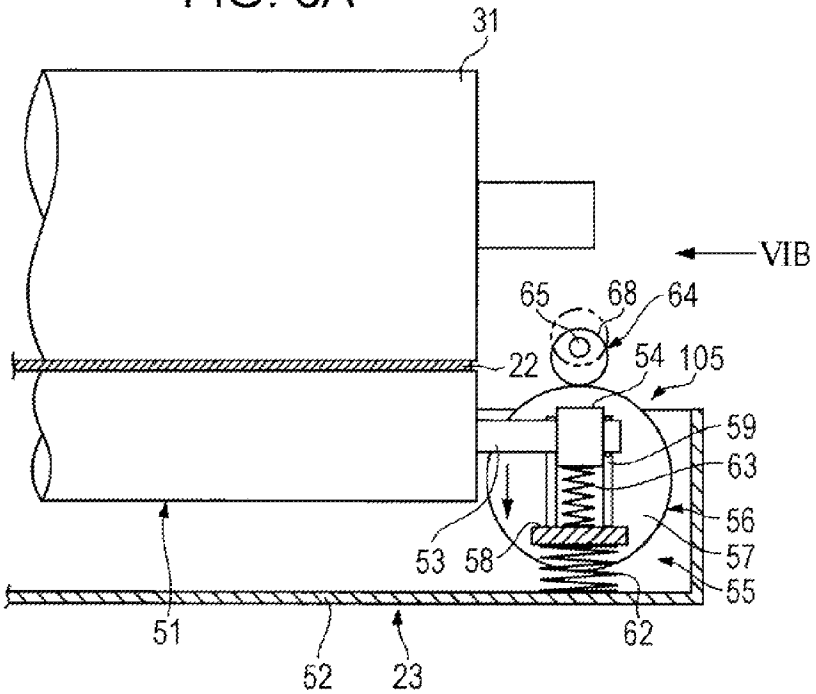
FIG. 6A is an explanatory diagram illustrating an example of a mechanism for allowing a first transfer condition for a first transfer device to be variable.

FIGS. 6A and 6B illustrate the load applying device 105 according to the first exemplary embodiment.

Referring to FIGS. 6A and 6B, each of the first transfer devices 23 includes a transfer casing 52 that faces and opens to the photoconductor 31. The first transfer roller 51 is disposed in the transfer casing 52, and both axial ends 53 of the first transfer roller 51 are rotatably supported by bearing members 54.

The load applying device 105 includes an urging and supporting mechanism 55 that supports the bearing member 54 so that the first transfer roller 51 is urged toward the photoconductor 31, and an urging force changing mechanism 64 that changes an urging force generated by the urging and supporting mechanism 55.

The urging and supporting mechanism 55 is disposed in the transfer casing 52, and includes a guide holder 56 by which the bearing member 54 is guidably held along forward and backward directions with respect to the photoconductor 31. The guide holder 56 includes a pair of circular holding plates 57 that are connected by a connecting plate 58. At portions facing each other of the holding plates 57, two sets of guide rails 59 extending along forward and backward directions with respect to the photoconductor 31 are provided. Further, guide pins 60 protrude from external surfaces of the pair of holding plates 57. The guide pins 60 are slidably fitted along guide grooves 61 formed on both side walls of the transfer casing 52.

The urging and supporting mechanism 55 supports the bearing member 54 in a movable manner along the two sets of guide rails 59 of the guide holder 56, includes a first urging spring 62 between the guide holder 56 and the bottom wall of the transfer casing 52 so as to urge the guide holder 56 toward the photoconductor 31, and further includes a second urging spring 63 between the guide holder 56 and the bearing member 54 so as to urge the bearing member 54 toward the photoconductor 31.

The urging force changing mechanism 64 is constituted by a moving mechanism that moves the guide holder 56 against an urging force generated by the urging and supporting mechanism 55, and includes a spindle 65 extending beyond the pair of holding plates 57 on the photoconductor 31 side of the pair of holding plates 57. The spindle 65 is connected to a rotary shaft of a driving motor 67 via a coupling 66. A pair of eccentric cams 68, which include cam surfaces the distance from which to the center of rotation changes, are fixed at the portion of the spindle 65 corresponding to the pair of holding plates 57. The pair of holding plates 57 are moved in a forward or backward direction in accordance with rotation positions of the eccentric cams 68 in response to a control signal from the control device 100, and thereby the guide holder 56 is moved in the forward or backward direction against the urging force of the second urging spring 63. Accordingly, the urging force changing mechanism 64 changes the urging force of the first urging spring 62 for the bearing member 54. The driving motor 67 is fixed to, for example, the transfer casing 52 via a bracket 69.

Current Supply Device

FIGS. 6A and 6B illustrate the current supply device 106 according to the first exemplary embodiment.

Referring to FIGS. 6A and 6B, the current supply device 106 includes a variable power supply 70 capable of adjusting a first transfer current, sets a first transfer current in the variable power supply 70 for each of the first transfer devices 23 (23*a* to 23*d*) in response to a control signal from the control device 100, and supplies the first transfer current from one of the axial ends 53 of the first transfer roller 51.

Operation of Image Forming Apparatus

Next, the operation of the image forming apparatus 20 according to the first exemplary embodiment will be described.

Figure 7:
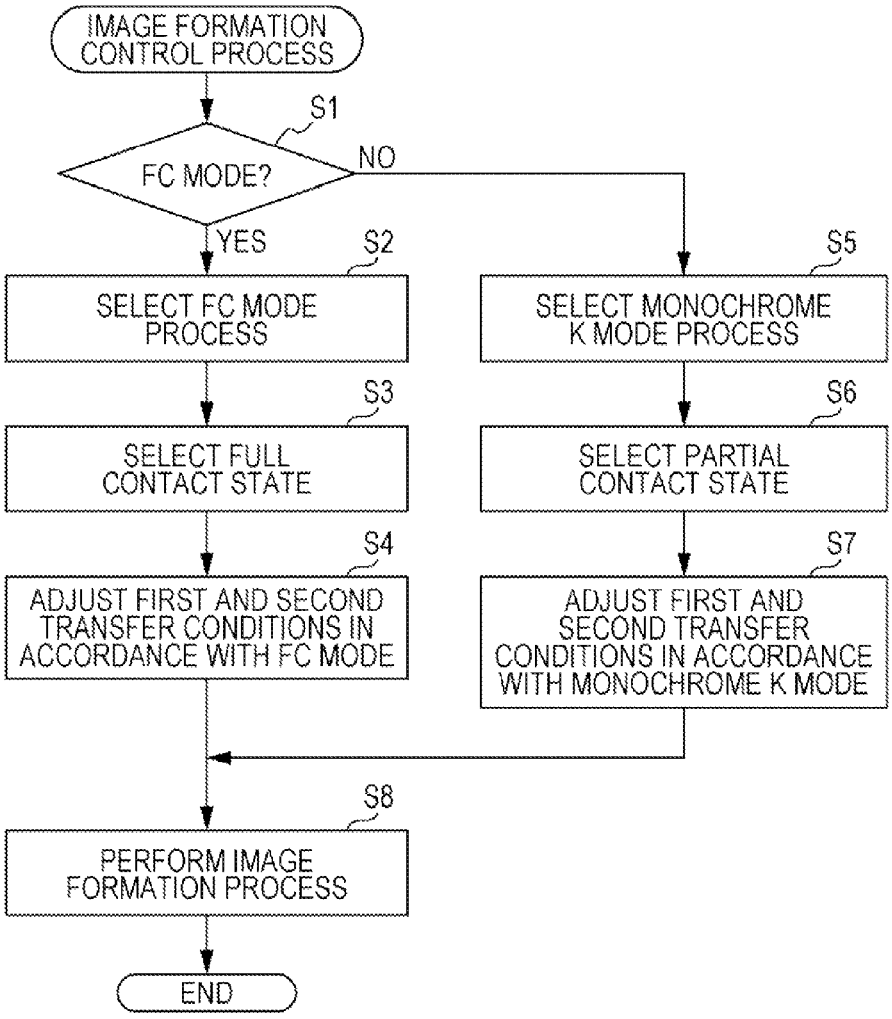
FIG. 7 is a flowchart illustrating a procedure of an image formation control process performed by the image forming apparatus according to the first exemplary embodiment.

FIG. 7 is a flowchart illustrating a procedure of an image formation control process performed by the image forming apparatus 20 according to the first exemplary embodiment.

As illustrated in FIG. 4, a user is capable of specifying a full-color mode (FC mode) or a monochrome K mode by operating the image formation mode SW 101.

FC Mode

Upon the FC mode being specified as an image formation mode, the control device 100 determines that the image formation mode is the FC mode (YES in step S1 in FIG. 7), and selects an FC mode process in step S2. In this state, the control device 100 selects a full contact state (see FIG. 8A) using the retraction mechanism 104 in step S3.

Subsequently, the control device 100 adjusts a first transfer condition and a second transfer condition in accordance with the FC mode in step S4.

In this exemplary embodiment, the control device 100 sets, as the first transfer condition for each of the first transfer devices 23 (23*a* to 23*d*) of the image forming units 21 (21*a* to 21*d*), loads and first transfer currents in the first transfer regions. Furthermore, the control device 100 sets, as the second transfer condition for the second transfer device 25, a second transfer voltage that enables second transfer.

After setting the first transfer condition and the second transfer condition, the control device 100 performs a series of image formation processes corresponding to the FC mode in step S8. Accordingly, the individual image forming units 21 (21*a* to 21*d*) form individual color component toner images, the individual first transfer devices 23 (23*a* to 23*d*) first transfer the individual color component toner images onto the intermediate transfer body 22, the second transfer device 25 collectively transfers (second transfers) the individual color component toner images onto the recording material 26, the fixing device 27 performs a fixing process thereon, and thereby the recording material 26 to which the image has been fixed is output.

Now, the first transfer condition and the second transfer condition in the FC mode will be described.

First Transfer Condition

Figure 8A:
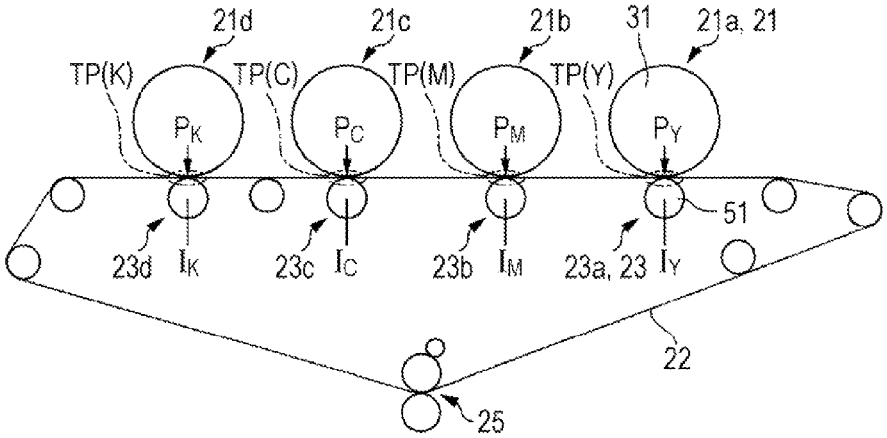
FIG. 8A is an explanatory diagram illustrating an operation state in an FC mode of the image forming apparatus according to the first exemplary embodiment.

As illustrated in FIG. 8A, loads in the first transfer regions TP1 (specifically, TP(Y) to TP(K)) of the individual image forming units 21 are represented by P (specifically, $P_Y$ to $P_K$), and first transfer currents in the first transfer regions TP1 are represented by I (specifically, $I_Y$ to $I_K$). In this case, a first transfer condition is set as illustrated in FIG. 9.

That is, regarding the loads P in the first transfer regions TP1, the load Pr in the first transfer region TP(K) of the image forming unit 21*d* (for color K in this exemplary embodiment) at the most downstream position in the movement direction of the intermediate transfer body 22 may be set to be higher than any of the loads $P_Y$ to $P_C$ in the first transfer regions TP(Y) to TP(C) of the image forming units 21*a* to 21*c* (for colors Y, M, and C in this exemplary embodiment) on the upstream side. The loads $P_Y$ to $P_C$ may be equal to one another, or may be set so that the load in the image forming unit 21 on a downstream side is higher than that in the image forming unit 21 on an upstream side.

In this exemplary embodiment, the above-described load applying device 105 may be used to set the loads P in the first transfer regions TP1.

Regarding the first transfer currents I, the first transfer current $I_K$ in the first transfer region TP(K) of the image forming unit 21*d* (for color K in this exemplary embodiment) at the most downstream position in the movement direction of the intermediate transfer body 22 may be set to be lower than any of the first transfer currents $I_Y$ to $I_C$ in the first transfer regions TP(Y) to TP(C) of the image forming units 21*a* to 21*c* (for colors Y, M, and C in this exemplary embodiment) on the upstream side. The first transfer currents $I_Y$ to $I_C$ may be equal to one another, or may be set so that the first transfer current in the image forming unit 21 on a downstream side is lower than that in the image forming unit 21 on an upstream side.

In this exemplary embodiment, the first transfer currents I ($I_Y$ to $I_K$) to be supplied to the first transfer rollers 51 may be variably set by the above-described current supply device 106.

Second Transfer Condition

Regarding the second transfer condition, the charging potential ($V_T$) of a toner image varies depending on a first transfer condition, as illustrated in FIG. 10A.

Figure 10B:
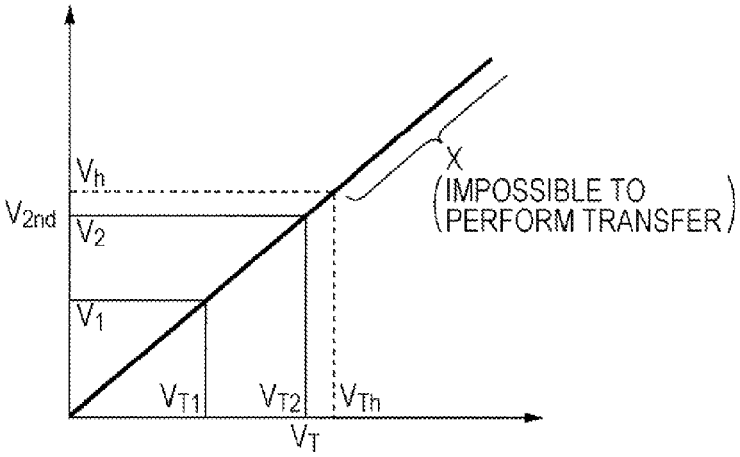
FIG. 10B is an explanatory diagram illustrating the relationship between a charging potential of a first transfer image and a second transfer voltage.

In the second transfer region TP2 of the second transfer device 25, as illustrated in FIG. 10B, if the charging potential $V_T$ of a toner image T increases, the electrostatic adhesion force of the toner image T on the intermediate transfer body 22 increases accordingly. Thus, it is necessary to set a second transfer voltage $V_{2nd}$ as a second transfer condition so that the second transfer voltage $V_{2nd}$ increases substantially proportionally in accordance with an increase in the charging potential $V_T$ of the toner image T.

For example, assuming that it is necessary to satisfy $V_{2nd}=V_1$ when $V_T=V_{T1}$, it is necessary to satisfy $V_{2nd}=V_2$ ($>V_1$) when $V_T=V_{T2}$ ($>V_{T1}$). However, if the charging potential $V_T$ of the toner image T becomes equal to or higher than a threshold potential $V_{Th}$ of a certain level, even if the second transfer voltage $V_{2nd}$ is set to be equal to or higher than a value $V_h$ corresponding to the threshold potential $V_{Th}$, an electrostatic adhesion force may become too high, which may disturb a second transfer operation for the toner image T. Thus, regarding the first transfer condition for the first transfer region TP1, it is necessary to prevent at least the charging potential $V_T$ of the toner image T from becoming the threshold potential $V_{Th}$ or more.

Monochrome K Mode

Referring back to FIG. 7, upon the monochrome K mode being specified as an image formation mode, the control device 100 determines that the image formation mode is the monochrome K mode (NO in step S1 in FIG. 7), and selects a monochrome K mode process in step S5. In this state, the control device 100 selects a partial contact state (see FIG. 8B) using the retraction mechanism 104 in step S6, so that the intermediate transfer body 22 is disposed so as not to be in contact with the photoconductors 31 of the image forming units 21 (21*a* to 21*c*) other than the image forming unit 21*d* (for color K in this exemplary embodiment) at the most downstream position, and that the first transfer rollers 51 of the first transfer devices 23*a* to 23*c* corresponding to the image forming units 21 (21*a* to 21*c*) other than the image forming unit 21*d* at the most downstream position are separated from the intermediate transfer body 22.

Subsequently, the control device 100 adjusts a first transfer condition and a second transfer condition in accordance with the monochrome K mode in step S7.

In this exemplary embodiment, the control device 100 sets, as the first transfer condition for the first transfer device 23*d* of the image forming unit 21*d*, a load and a first transfer current in the first transfer region. Furthermore, the control device 100 sets, as the second transfer condition for the second transfer device 25, a second transfer voltage that enables second transfer.

After setting the first transfer condition and the second transfer condition, the control device 100 performs a series of image formation processes corresponding to the monochrome K mode in step S8. Accordingly, the image forming unit 21*d* forms a K toner image, the first transfer device 23*d* first transfers the K toner image onto the intermediate transfer body 22, the second transfer device 25 collectively transfers (second transfers) the K toner image onto the recording material 26, the fixing device 27 performs a fixing process thereon, and thereby the recording material 26 to which the image has been fixed is output.

Now, the first transfer condition and the second transfer condition in the monochrome K mode will be described.

First Transfer Condition

Figure 8B:
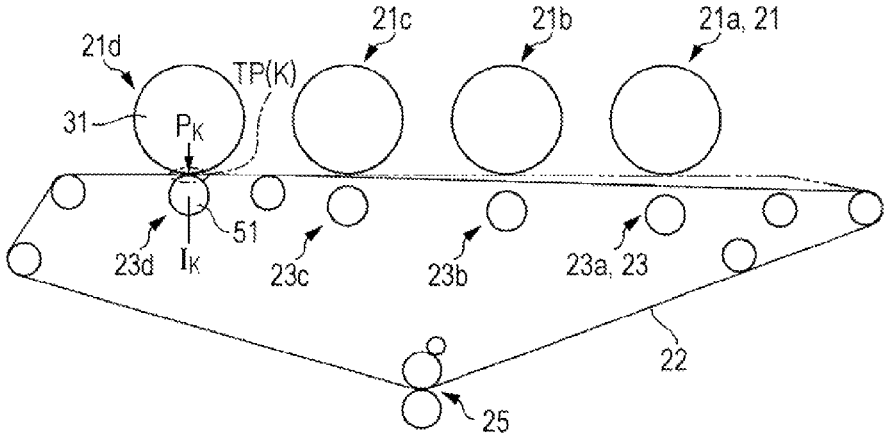
FIG. 8B is an explanatory diagram illustrating an operation state in a monochrome K mode of the image forming apparatus according to the first exemplary embodiment.

As illustrated in FIG. 8B, a load in the first transfer region TP(K) of the image forming unit 21*d* is represented by $P_K$, and a first transfer current in the first transfer region TP(K) is represented by $I_F$. In this case, a first transfer condition is set as illustrated in FIG. 9.

That is, regarding the load P in the first transfer regions TP1, the load $P_K$ in the first transfer region TP(K) of the image forming unit 21*d* (for color K in this exemplary embodiment) at the most downstream position in the movement direction of the intermediate transfer body 22 may be set to be higher than the load $P_K$ in the FC mode (represented by "$P_K$(FC mode)").

In this exemplary embodiment, the above-described load applying device 105 may be used to set the load $P_K$ in the first transfer region TP1.

Regarding the first transfer current I, the first transfer current $I_K$ in the first transfer region TP(K) of the image forming unit 21*d* (for color K in this exemplary embodiment) at the most downstream position in the movement direction of the intermediate transfer body 22 may be set to be lower than the first transfer current $I_K$ in the FC mode (represented by "$I_K$(FC mode)").

In this exemplary embodiment, the first transfer current $I_K$ to be supplied to the first transfer roller 51 may be variably set by the above-described current supply device 106.

Second Transfer Condition

Regarding the second transfer condition, the second transfer voltage $V_{2nd}$ corresponding to the charging potential $V_T$ of a K toner image may be set in view of the first transfer condition in the monochrome K mode.

Layer Thickness and Charging Characteristic of First Transfer Toner Image

Figure 11A:
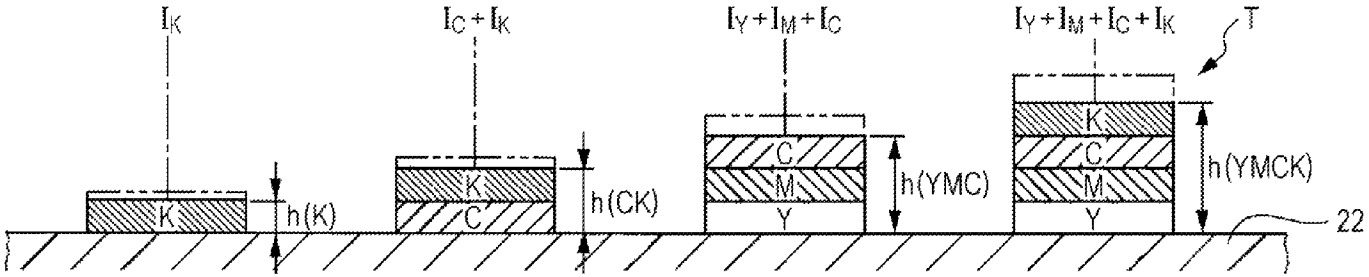
FIG. 11A is an explanatory diagram illustrating a state in which various types of first transfer images are transferred onto an intermediate transfer body according to the first exemplary embodiment.

In the first exemplary embodiment, in the FC mode or the monochrome K mode, color component toner images are formed in one or plural layers by the individual image forming units 21 (21*a* to 21*d*), as illustrated in FIG. 11A. Examples of a toner image include a "YMCK image" in which color component toner images of Y, M, C, and K are superposed one on top of another, a "YMC image" in which color component toner images of Y, M, and C are superposed one on top of another, a "CK image" in which two color component toner images on the downstream side are superposed one on top of another, and a "K image" composed of only a K toner image.

Figure 11B:
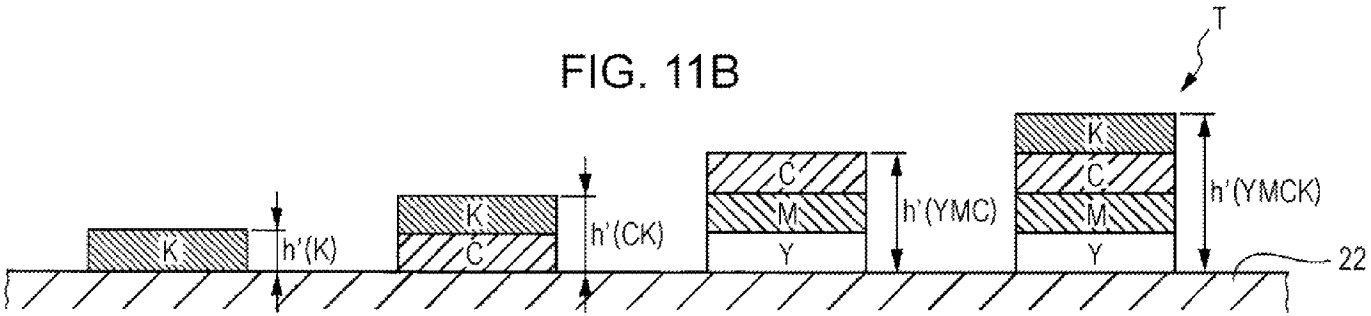
FIG. 11B is an explanatory diagram illustrating a state in which various types of first transfer images are transferred onto an intermediate transfer body according to a first comparative embodiment.

In this case, a first transfer condition different from the above-described first transfer condition is assumed in which the loads and first transfer currents in the first transfer regions of all the image forming units 21 are set to be equal to one another, for example, as in a first comparative embodiment. Then, the result illustrated in FIG. 11B is obtained.

Specifically, regarding the "YMCK image", a toner image having a layer thickness h'(YMCK) is formed through four substantially equivalent first transfer operations with passage through four first transfer regions.

Regarding the "YMC image", a K toner image is not formed but substantially one first transfer operation is performed in the first transfer region for K, and thus a toner image having a layer thickness h'(YMC) is formed through four substantially equivalent first transfer operations with passage through four first transfer regions.

Regarding the "CK" image, a toner image having a layer thickness h'(CK) is formed through two substantially equivalent first transfer operations with passage through two first transfer regions.

Regarding the "K" image, a toner image having a layer thickness h'(K) is formed through one first transfer operation with passage through one first transfer region.

In contrast, in the first exemplary embodiment, the "YMCK image" is formed through passage through four first transfer regions. The first transfer condition at the most downstream position is different from the first transfer condition on the upstream side, that is, the load in the first transfer region at the most downstream position is higher than any of loads in the other first transfer regions, and the first transfer current in the first transfer region at the most downstream position is lower than any of first transfer currents in the other first transfer regions. Thus, a toner image having a layer thickness h(YMCK) that is smaller than the layer thickness h'(YMCK) according to the first comparative embodiment is obtained. Further, since the first transfer current $I_K$ is low, the charging potential of the toner image is set to be lower than that in the first comparative embodiment accordingly.

Also, the "YMC image" is formed through passage through four first transfer regions. Since the first transfer condition at the most downstream position is appropriately set, a toner image having a layer thickness h(YMC) that is smaller than the layer thickness h'(YMC) according to the first comparative embodiment is obtained. Further, since the first transfer current $I_K$ is low, the charging potential of the toner image is set to be lower than that in the first comparative embodiment accordingly.

Also, the "CK image" is formed through passage through two first transfer regions. Since the first transfer condition at the most downstream position is appropriately set, a toner image having a layer thickness h(CK) that is smaller than the layer thickness h'(CK) according to the first comparative embodiment is obtained. Further, since the first transfer current $I_K$ is low, the charging potential of the toner image is set to be lower than that in the first comparative embodiment accordingly.

Also, the "K image" is formed through passage through one first transfer region. Since the first transfer condition at the most downstream position is appropriately set, a toner image having a layer thickness h(K) that is smaller than the layer thickness h'(K) according to the first comparative embodiment is obtained. Further, since the first transfer current $I_K$ is low, the charging potential of the toner image is set to be lower than that in the first comparative embodiment accordingly.

Now, the characteristic of the "K image" in the FC mode is compared with the characteristic of the "K image" in the monochrome K mode. In the FC mode, the "K image" is formed through passage through only one first transfer region at the most downstream position. On the other hand, toner images formed through passage through first transfer regions on the upstream side, such as "YMC image", "MC image", and "C image", have passed through plural first transfer regions. Thus, if the load $P_K$ in the first transfer region at the most downstream side is very high, the adhesion force (electrostatic adhesion force+non-electrostatic adhesion force) between color component toner images that have passed through plural first transfer regions and the intermediate transfer body 22 increases more than necessary, though sufficient toner cohesion of the color component toner images is ensured. As a result, a transfer performance in the second transfer region may be degraded.

On the other hand, in the monochrome K mode, the "K image" is formed through passage through only one first transfer region at the most downstream position, and a charged color component toner image does not exist therearound. Thus, even if the load $P_K$ in the first transfer region at the most downstream position is set to be higher than that in the FC mode, the adhesion force between the "K image" and the intermediate transfer body 22 does not become too high in the first transfer region, and sufficient toner cohesion of the "K image" is ensured.

Furthermore, in the monochrome K mode, the first transfer current $I_K$ in the first transfer region is set to be lower than that in the FC mode for the following reason. That is, in the FC mode, superposing a color component toner image on another color component toner image is taken into consideration, and thus a high first transfer current $I_K$ corresponding to the resistance of a portion at which plural color component toner images are superposed is necessary. In the monochrome K mode, a toner image of a single color (K) is handled, and the resistance of the toner image is low. This allows the first transfer current $I_K$ to be lower than that in the FC mode. In each first transfer region, constant current control is performed, and ideally the resistance of toner does not affect formation of a transfer electric field. Actually, however, inter-toner discharging and an adhesion force of toner at various portions exert an influence, and thus the optimum value of the first transfer current $I_K$ varies depending on the resistance of toner.

Transfer Action in Second Transfer Region

Figure 12A:
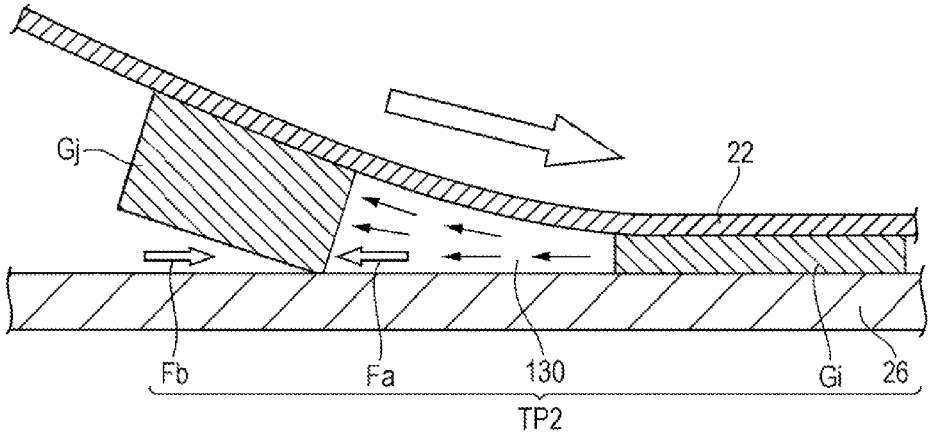
FIG. 12A is an explanatory diagram schematically illustrating a state in which an image (plural line images) is transferred onto a recording material in a second transfer region according to the first exemplary embodiment.
Figure 12B:
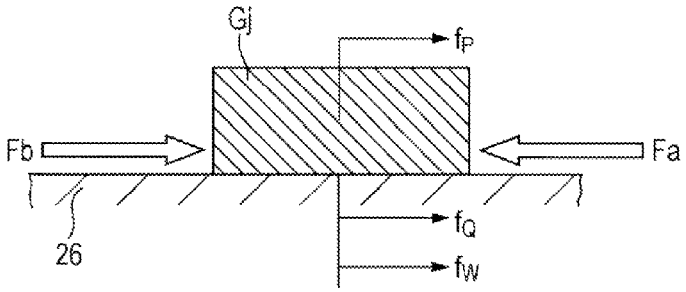
FIG. 12B is an explanatory diagram schematically illustrating the relationship among forces that act on an image.

When such a first transfer toner image T reaches the second transfer region TP2, an effect of a second transfer electric field generated by a second transfer voltage causes the first transfer toner image T to be transferred onto the recording material 26, as illustrated in FIG. 12A.

Here, it is assumed that the first transfer toner image T includes plural line images G (Gi and Gj in this exemplary embodiment) arranged substantially in parallel with the movement direction of the intermediate transfer body 22 at a certain interval (for example, 2 to 4 mm).

Also, it is assumed that the line images G (Gi and Gj) on the intermediate transfer body 22 reach the second transfer region TP2 and are pressed to be in contact with the recording material 26. Then, the air in a gap 130 between the line images G (Gi and Gj) is compressed, and a fluid force Fa generated by the compressed air in the gap 130 is applied to the line image Gj located on the upstream side in the movement direction of the intermediate transfer body 22.

At this time, as illustrated in FIG. 12A, an electrostatic adhesion force $f_Q$ and a non-electrostatic adhesion force $f_W$ such as a Van der Waals force act between the line image Gj and the recording material 26. In addition, setting the load $P_K$ in the first transfer region for K to be high causes the line image Gj to be pressed so that the layer thickness thereof becomes sufficiently small, and thus the toner cohesion in the line image Gj is larger than that in the first comparative embodiment. Therefore, it is estimated that a drag $f_P$ generated in accordance with toner cohesion acts in the direction resisting the fluid force Fa generated by the compressed air in the line image Gj.

Figure 13A:
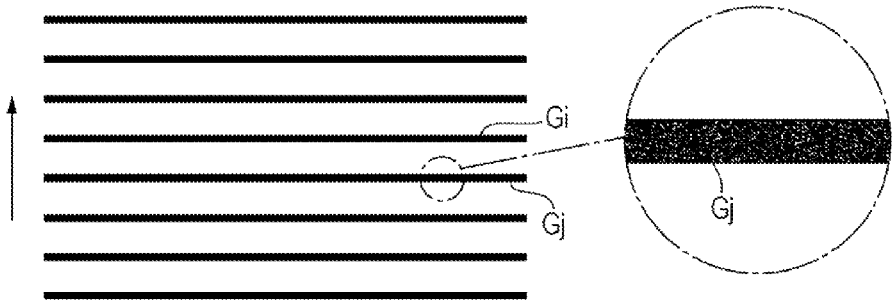
FIG. 13A is an explanatory diagram illustrating an example of a transfer result of a transferred image (plural line images) on a recording material according to the first exemplary embodiment.

Thus, a fluid stopping force Fb, which is composed of $f_Q+f_W+f_P$, acts on the line image Gj in the direction resisting the fluid force Fa generated by the compressed air. If the drag $f_P$ generated in accordance with toner cohesion is sufficiently ensured, the fluid stopping force Fb may be set to be larger than the fluid force Fa generated by the compressed air. If such a state is ensured, the occurrence of toner scattering at a portion of the line image Gj caused by the fluid force Fa generated by the compressed air may be effectively avoided, as illustrated in FIG. 13A.

In this exemplary embodiment, it is determined that toner scattering hardly occurs in the line image Gj in a case where the first transfer toner image T is any of the "YMCK image", the "YMC image", the "CK image", and the "K image". In particular, a color component toner image that passes through a smaller number of first transfer regions (for example, a K toner image or a C toner image) is pressed with a load in the first transfer region a small number of times and is injected with charge of a first transfer current a small number of times, compared to a Y toner image and an M toner image formed on the upstream side, and thus the toner cohesion of the toner image and the charging potential of the toner image tend to be insufficient. In this exemplary embodiment, the load and first transfer current in the first transfer region for color K at the most downstream position are appropriately set, and thus the above-described tendency may be effectively suppressed.

Figure 13B:
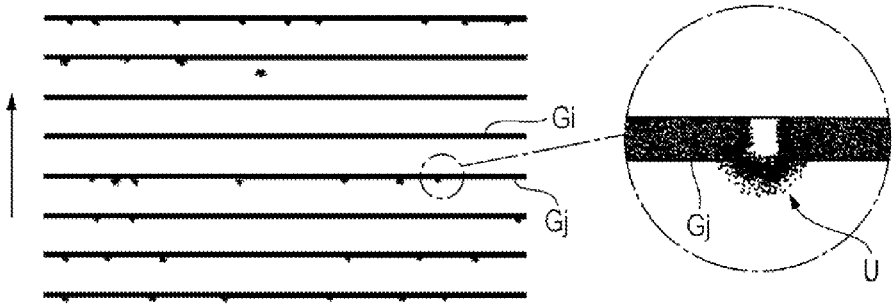
FIG. 13B is an explanatory diagram illustrating an example of a transfer result of a transferred image (plural line images) on a recording material according to the first comparative embodiment.

Compared to the first exemplary embodiment, in the first comparative embodiment, the line image Gj is insufficiently pressed with a load in the first transfer region, and the drag generated by toner cohesion is likely to be insufficient. Thus, even if line images G similar to those in the first exemplary embodiment are formed, toner scattering U may occur in a portion of the line image Gj due to the fluid force Fa generated by compressed air, as illustrated in FIG. 13B.

In the first exemplary embodiment, the first transfer current $I_K$ of the image forming unit 21*d* (for color K in this exemplary embodiment) at the most downstream position is appropriately set, and thus a first transfer toner image is not subjected to unnecessary discharging or unnecessary charge injection in the first transfer region for color K. Thus, an unnecessary increase in charging potential $V_T$ of the first transfer toner image T (see FIG. 10A) may be suppressed, and insufficient density of a second transfer image caused by an insufficient second transfer electric field generated by a second transfer voltage in the second transfer region may be suppressed.

If the first transfer current $I_K$ for color K is decreased, it seems that the charging potential $V_T$ of a K toner image becomes insufficient. However, the load $P_K$ in the first transfer region is set to be high, and thus the effective resistance in the first transfer region decreases. If a second transfer condition is set in view of this, the density of a second transfer image does not decrease though the first transfer efficiency slightly decreases.

Second Exemplary Embodiment

Figure 14:
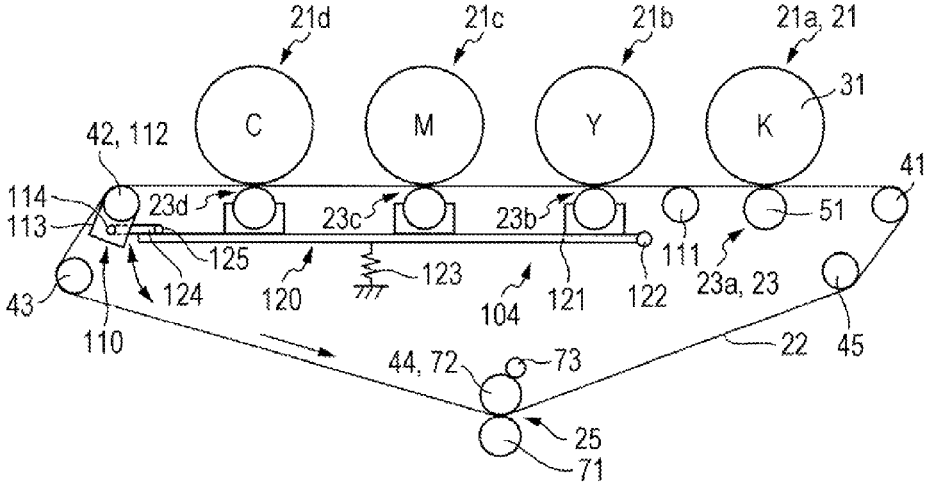
FIG. 14 is an explanatory diagram illustrating a part of an image forming apparatus according to a second exemplary embodiment.

FIG. 14 illustrates a part of an image forming apparatus according to a second exemplary embodiment.

Referring to FIG. 14, the basic configuration of the image forming apparatus is substantially similar to that of the first exemplary embodiment. The point different from the first exemplary embodiment is that the arrangement order of the image forming units 21 (21*a* to 21*d*) and the position of the retraction mechanism 104 are changed, and a first transfer condition is changed accordingly. The same elements as those in the first exemplary embodiment are denoted by the same reference numerals, and the detailed description thereof is omitted.

In the second exemplary embodiment, unlike in the first exemplary embodiment, the image forming units 21 (21*a* to 21*d*) are arranged in the order of K, Y, M, and C from the upstream side in the movement direction of the intermediate transfer body 22.

The retraction mechanism 104 according to the second exemplary embodiment is, unlike in the first exemplary embodiment, disposed so as to correspond to the image forming units 21 (21*b* to 21*d*) other than the image forming unit 21*a* located at the most upstream position in the movement direction of the intermediate transfer body 22, and causes the intermediate transfer body 22 to be in contact with or separated from the photoconductors 31 of the image forming units 21 (21*b* to 21*d*) in accordance with the FC mode or the monochrome K mode. In this exemplary embodiment, the retraction mechanism 104 moves the first transfer rollers 51 of the first transfer devices 23 corresponding to the image forming units 21 (21*b* to 21*d*) so that the first transfer rollers 51 are not in contact with the intermediate transfer body 22 when the intermediate transfer body 22 is separated from the photoconductors 31 of the image forming units 21 (21*b* to 21*d*).

Specifically, the retraction mechanism 104 includes, substantially similarly to the first exemplary embodiment, the intermediate transfer body contact and separation mechanism 110 that causes the intermediate transfer body 22 to be in contact with or separated from the photoconductors 31 of the image forming units 21 (21*b* to 21*d*), and the interlock mechanism 120 that moves the first transfer devices 23 (23*b* to 23*d* in this exemplary embodiment) in conjunction with the intermediate transfer body contact and separation mechanism 110. In the intermediate transfer body contact and separation mechanism 110 according to the second exemplary embodiment, unlike in the first exemplary embodiment, the fixed positioning roller 111 that is set in advance in a fixed manner as a movement trail position of the intermediate transfer body 22 is disposed between the image forming units 21*a* and 21*b* on the back surface of the intermediate transfer body 22, the movable positioning roller 112 (also functions as a tension roller 42 in this exemplary embodiment) that is changeably set as a movement control position of the intermediate transfer body 22 is disposed on the back surface of the intermediate transfer body 22 at a position on the downstream side of the image forming unit 21*d* located at the most downstream position in the movement direction of the intermediate transfer body 22, and the movable positioning roller 112 is supported by the swing table 113 that is swingable about the swing fulcrum 114. The interlock mechanism 120 includes substantially the same elements as in the first exemplary embodiment (the swing plate 121, the swing fulcrum 122, the urging spring 123, the rotary member 124, and the holding piece 125). Unlike in the first exemplary embodiment, the swing fulcrum 122 is set at a portion corresponding to the intermediate position between the image forming units 21*a* and 21*b*, and the first transfer devices 23 (23*b* to 23*d*) are disposed on the swing plate 121 in a fixed manner.

In the second exemplary embodiment, a first transfer condition is set in accordance with the FC mode or the monochrome K mode, as illustrated in FIGS. 15A to 16B.

In FIGS. 15A to 16B, the loads in the first transfer regions TP1 (specifically, TP(K) to TP(C)) of the individual image forming units 21 are represented by P (specifically, $P_K$ to $P_C$), and the first transfer currents in the first transfer regions TP1 are represented by I (specifically, $I_K$ to $I_C$).

FC Mode

A first transfer condition in the FC mode is set as illustrated in FIG. 16A.

That is, regarding the loads P in the first transfer regions TP1, the load $P_C$ in the first transfer region TP(C) of the image forming unit 21*d* (for color C in this exemplary embodiment) at the most downstream position in the movement direction of the intermediate transfer body 22 may be set to be higher than any of the loads $P_K$ to $P_M$ in the first transfer regions TP(K) to TP(M) of the image forming units 21*a* to 21*c* (for colors K, Y, and M in this exemplary embodiment) on the upstream side. The loads $P_K$ to $P_M$ may be equal to one another, or may be set so that the load in the image forming unit 21 on a downstream side is higher than that in the image forming unit 21 on an upstream side.

Regarding the first transfer currents I, the first transfer current $I_C$ in the first transfer region TP(C) of the image forming unit 21*d* (for color C in this exemplary embodiment) at the most downstream position in the movement direction of the intermediate transfer body 22 may be set to be lower than any of the first transfer currents $I_K$ to $I_M$ in the first transfer regions TP(K) to TP(M) of the image forming units 21*a* to 21*c* (for colors K, Y, and M in this exemplary embodiment) on the upstream side. The first transfer currents $I_K$ to $I_M$ may be equal to one another, or may be set so that the first transfer current in the image forming unit 21 on a downstream side is lower than that in the image forming unit 21 on an upstream side.

Monochrome K Mode

A first transfer condition in the monochrome K mode is set as illustrated in FIG. 16A.

That is, regarding the load P in the first transfer region TP1, the load $P_K$ in the first transfer region TP(K) of the image forming unit 21*a* (for color K in this exemplary embodiment) at the most upstream position in the movement direction of the intermediate transfer body 22 needs to be set to be at least higher than the load $P_K$ in the FC mode (represented by "$P_K$(FC mode)"). For example, in a case where the image formation speed in the monochrome K mode is higher than the image formation speed in the FC mode, it is desired that the load $P_K$ be set to be higher than the load $P_C$(FC mode) in the image forming unit 21*d* (for color C in this exemplary embodiment) at the most downstream position.

Regarding the first transfer current I, the first transfer current $I_K$ in the first transfer region TP(K) of the image forming unit 21*a* (for color K in this exemplary embodiment) at the most upstream position in the movement direction of the intermediate transfer body 22 need to be set to be at least lower than the first transfer current $I_K$ in the FC mode (represented by "$I_K$(FC mode)"). For example, in a case where the image formation speed in the monochrome K mode is higher than the image formation speed in the FC mode, and where the load $P_K$ in the first transfer region TP(K) is set to be higher than any of the loads $P_Y$ to $P_C$ in the other first transfer regions TP(Y) to TP(C), it is desired that the first transfer current $I_K$ be set to be lower than the first transfer current $I_C$(FC mode) in the image forming unit 21*d* (for color C in this exemplary embodiment) at the most downstream position.

Figure 15A:
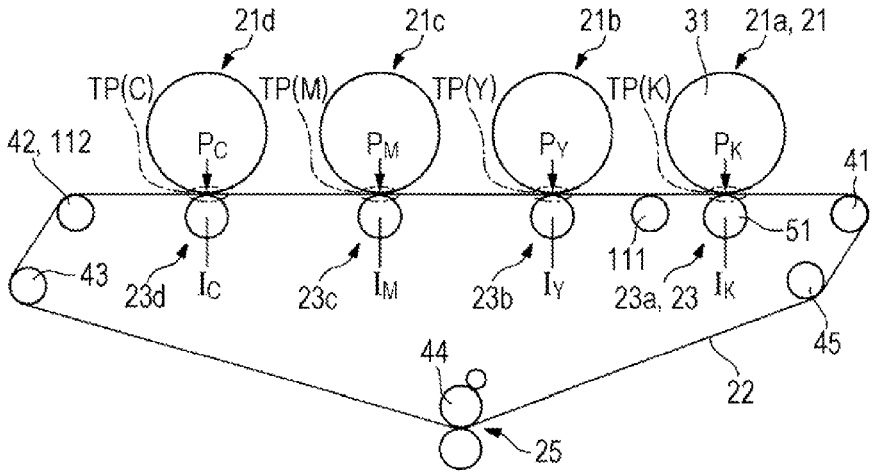
FIG. 15A is an explanatory diagram illustrating an operation state in the FC mode of the image forming apparatus according to the second exemplary embodiment.

As described above, in the second exemplary embodiment, when the FC mode is selected, a full contact state is employed in which the retraction mechanism 104 causes all the image forming units 21 (21*a* to 21*d*) to be in contact with the intermediate transfer body 22, as illustrated in FIG. 15A, and the above-described first transfer condition is satisfied. Accordingly, substantially similarly to the first exemplary embodiment, even if a first transfer toner image includes plural line images, the occurrence of toner scattering in a portion of a line image caused by a fluid force generated by compressed air in a gap between line images may be suppressed. Furthermore, insufficient density of a second transfer image resulting from unnecessary discharging or unnecessary charge injection to a first transfer toner image may be effectively avoided.

Figure 15B:
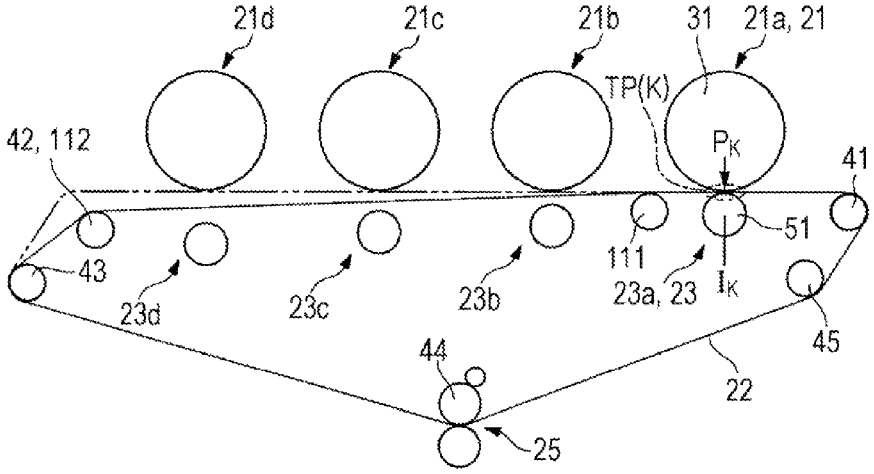
FIG. 15B is an explanatory diagram illustrating an operation state in the monochrome K mode of the image forming apparatus according to the second exemplary embodiment.

When the monochrome K mode is selected, a partial contact state is employed in which the retraction mechanism 104 causes one of the image forming units 21 (21*a* in this exemplary embodiment) to be in contact with the intermediate transfer body 22, as illustrated in FIG. 15B, and the above-described first transfer condition is satisfied. Accordingly, substantially similarly to the first exemplary embodiment, even if a first transfer toner image of color K includes plural line images, the occurrence of toner scattering in a portion of a line image caused by a fluid force generated by compressed air in a gap between line images may be suppressed. Furthermore, insufficient density of a second transfer image resulting from unnecessary discharging or unnecessary charge injection to a first transfer toner image may be effectively avoided.

In the second exemplary embodiment, when the FC mode is selected, the load $P_C$ in the first transfer region TP(C) of the image forming unit 21*d* (for color C in this exemplary embodiment) at the most downstream position is set to be higher than any other load, and the first transfer current $I_C$ in the first transfer region TP(C) is set to be lower than any other first transfer current. If toner scattering is not remarkable in the case of forming plural line images of a C toner image formed by the image forming unit 21*d* at the most downstream position or an M toner image formed by the image forming unit 21*c* in the preceding stage, the first transfer condition for the image forming unit 21*d* at the most downstream position may be set to be equivalent to the first transfer condition for the image forming unit 21*c* (for color M in this exemplary embodiment) in the preceding state, as in a modification of the second exemplary embodiment illustrated in FIG. 16B.

Third Exemplary Embodiment

The basic configuration of an image forming apparatus according to a third exemplary embodiment is substantially similar to that of the first exemplary embodiment. Unlike in the first exemplary embodiment, switching of an image formation speed is performed together with selection of an image formation mode. Also, an image formation speed is taken into consideration at the time of setting a first transfer condition and a second transfer condition.

Figure 17:
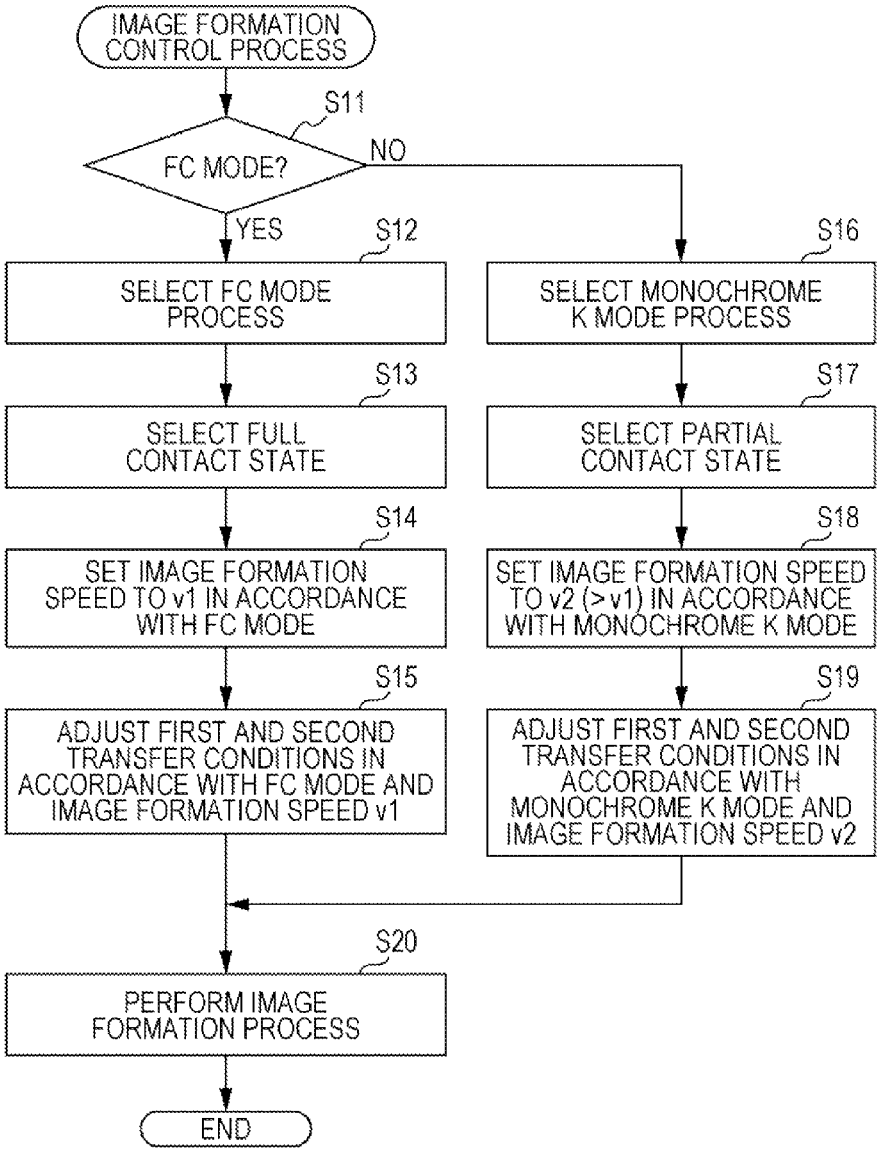
FIG. 17 is a flowchart illustrating a procedure of an image formation control process performed by an image forming apparatus according to a third exemplary embodiment.

FIG. 17 is a flowchart illustrating a procedure an image formation control process performed by the image forming apparatus according to the third exemplary embodiment.

Referring to FIG. 17, a user is capable of specifying the FC mode or the monochrome K mode by operating the image formation mode SW 101 (see FIG. 4).

FC Mode

Upon the FC mode being specified as an image formation mode, the control device 100 determines that the image formation mode is the FC mode (YES in step S11 in FIG. 17), and selects an FC mode process in step S12. Also, the control device 100 selects a full contact state (see FIG. 8A) using the retraction mechanism 104 in step S13, and sets an image formation speed v1 in accordance with the FC mode in step S14.

Subsequently, the control device 100 adjusts a first transfer condition and a second transfer condition in accordance with the FC mode and the image formation speed v1 in step S15.

In this exemplary embodiment, the control device 100 sets, as the first transfer condition for each of the first transfer devices 23 (23*a* to 23*d*) of the image forming units 21 (21*a* to 21*d*), loads and first transfer currents in the first transfer regions. Furthermore, the control device 100 sets, as the second transfer condition for the second transfer device 25, a second transfer voltage that enables second transfer.

After setting the first transfer condition and the second transfer condition, the control device 100 performs a series of image formation processes corresponding to the FC mode in step S20.

Monochrome K Mode

Upon the monochrome K mode being specified as an image formation mode, the control device 100 determines that the image formation mode is the monochrome K mode (NO in step S11 in FIG. 17), selects a monochrome K mode process in step S16, selects a partial contact state (see FIG. 8B) using the retraction mechanism 104 in step 217, and sets an image formation speed v2 (>v1) in accordance with the monochrome K mode in step S18.

Subsequently, the control device 100 adjusts a first transfer condition and a second transfer condition in accordance with the monochrome K mode and the image formation speed v2 in step S19.

In this exemplary embodiment, the control device 100 sets, as the first transfer condition for the first transfer device 23*d* of the image forming unit 21*d*, a load and a first transfer current in the first transfer region. Furthermore, the control device 100 sets, as the second transfer condition for the second transfer device 25, a second transfer voltage that enables second transfer.

After setting the first transfer condition and the second transfer condition, the control device 100 performs a series of image formation processes corresponding to the monochrome K mode in step S20.

Relationship Between Image Formation Speed and First Transfer Condition

Figures 18A, 18B:
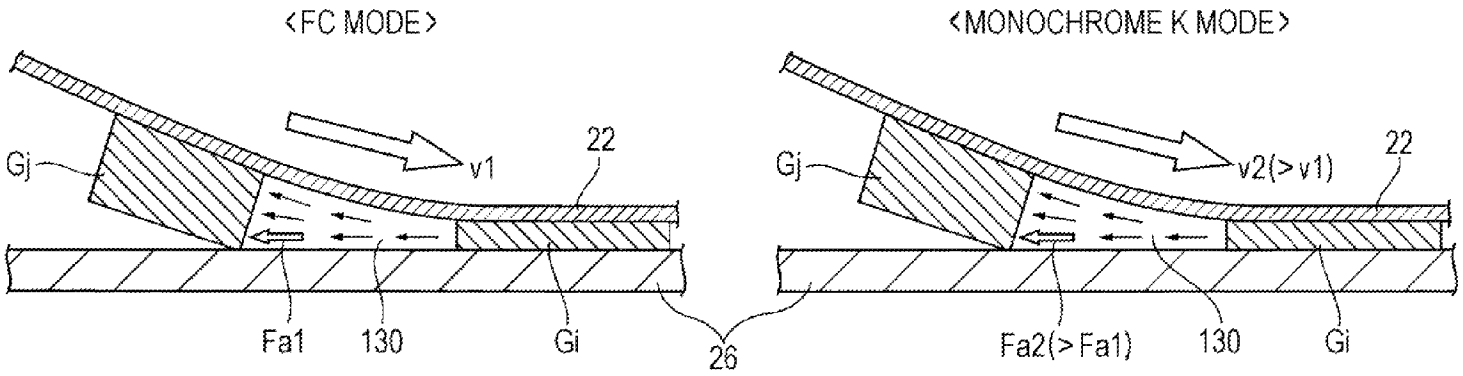
FIG. 18A is an explanatory diagram schematically illustrating an image transfer state in a second transfer region in the FC mode and the monochrome K mode of the image forming apparatus according to the third exemplary embodiment.
FIG. 18B is an explanatory diagram illustrating first transfer conditions in individual image formation modes.

In the FC mode, as illustrated in FIG. 18A, in a case where a first transfer toner image includes plural line images G (Gi and Gj) arranged at a certain interval along the movement direction of the intermediate transfer body 22, a fluid force Fa1 generated by compressed air acts in the gap 130 between line images G in accordance with the movement speed (corresponding to the image formation speed v1) of the intermediate transfer body 22.

In this state, a first transfer condition is set as illustrated in FIG. 18B.

That is, regarding the loads P in the first transfer regions TP1, the load $P_K$ in the first transfer region TP(K) of the image forming unit 21*d* (for color K in this exemplary embodiment) at the most downstream position in the movement direction of the intermediate transfer body 22 may be set to be higher than any of the loads Pr to Pc in the first transfer regions TP(Y) to TP(C) of the image forming units 21 (21*a* to 21*c* in this exemplary embodiment) on the upstream side. The loads $P_Y$ to $P_C$ may be equal to one another, or may be set so that the load in the image forming unit 21 on a downstream side is higher than that in the image forming unit 21 on an upstream side.

Regarding the first transfer currents I, the first transfer current $I_K$ in the first transfer region TP(K) of the image forming unit 21*d* (for color K in this exemplary embodiment) at the most downstream position in the movement direction of the intermediate transfer body 22 may be set to be lower than any of the first transfer currents $I_Y$ to $I_C$ in the first transfer regions TP(Y) to TP(C) of the image forming units 21 (21*a* to 21*c* in this exemplary embodiment) on the upstream side. The first transfer currents $I_Y$ to $I_C$ may be equal to one another, or may be set so that the first transfer current in the image forming unit 21 on a downstream side is lower than that in the image forming unit 21 on an upstream side.

In a case where an image formation process corresponding to the FC mode is performed, substantially similarly to the first exemplary embodiment, even if a first transfer toner image includes plural line images, the occurrence of toner scattering in a portion of a line image caused by the fluid force Fa1 generated by compressed air in the gap 130 between line images G may be suppressed. Furthermore, insufficient density of a second transfer image resulting from unnecessary discharging or unnecessary charge injection to a first transfer toner image may be effectively avoided.

In the monochrome K mode, as illustrated in FIG. 18A, in a case where a first transfer toner image includes the above-described plural line images G (Gi and Gj), a fluid force Fa2 (>Fa1) generated by compressed air acts in the gap 130 between the line images G in accordance with the movement speed (corresponding to the image formation speed v2) of the intermediate transfer body 22.

In this state, a first transfer condition is set as illustrated in FIG. 18B.

That is, regarding the load P in the first transfer region TP1, the load $P_K$ in the first transfer region TP(K) of the image forming unit 21*a* (for color K in this exemplary embodiment) at the most downstream position in the movement direction of the intermediate transfer body 22 may be set to be higher than the load $P_K$ in the FC mode (represented by "$P_K$(FC mode)").

Regarding the first transfer current I, the first transfer current $I_K$ in the first transfer region TP(K) of the image forming unit 21*a* (for color K in this exemplary embodiment) at the most downstream position in the movement direction of the intermediate transfer body 22 may be set to be lower than the first transfer current $I_K$ in the FC mode (represented by "$I_K$(FC mode)").

In this exemplary embodiment, an image formation speed is higher in the monochrome K mode than in the FC Mode. Accordingly, the compression rate of the air in the gap 130 between line images G increases, and a fluid force generated by the compressed air in the gap 130 increases. Thus, in the monochrome K mode in which the image formation speed is high, toner cohesion of the line images G is increased by increasing the load $P_K$ in the first transfer region so as to suppress the occurrence of toner scattering in the line images G.

Furthermore, in the monochrome K mode in this exemplary embodiment, the load $P_K$ in the first transfer region TP(K) of the image forming unit 21*d* is set to be higher than the load in any other first transfer region, and thus the combined resistance in the first transfer region TP(K) decreases. However, the first transfer current $I_K$ in the first transfer region TP(K) is set to be lower than the first transfer current in any other first transfer region, and accordingly, unnecessary discharging or unnecessary charge injection in the first transfer region TP(K) may be suppressed, and a transfer operation in the second transfer region is not disturbed.

Modification of Third Exemplary Embodiment

In the third exemplary embodiment, an image formation speed varies depending on whether the image formation mode is the FC mode or the monochrome K mode. Alternatively, in the FC mode and the monochrome K mode, an image formation speed may be changed depending on image quality, that is, normal image quality or high-resolution image quality.

For example, it is assumed that a standard FC mode or a high-resolution FC mode is selectable in the FC mode. In this case, the image formation speed is set to be v11 in the standard FC mode, and the image formation speed is set to be v12 (<v11) in the high-resolution FC mode.

At this time, a first transfer condition may be set so that a load in the first transfer region is higher when the image formation speed is higher, and that a first transfer current is lower when the image formation speed is higher.

In the FC mode, in a case where a low image quality that is lower than the standard image quality is selectable or a case where any one of plural stages of the high-resolution FC mode is selectable, an image formation speed may be switched in accordance with the above-described standard, and a first transfer condition may be set in view of the image formation speed. In the monochrome K mode, in a case where switching between image formation speeds is performed, a first transfer condition may be set in accordance with the above-described standard.

In a case where there is provided a device capable of detecting whether or not line images exist to determine the type of image, if the device detects that an image to be output does not include line images which degrade image quality, a first transfer condition similar to that in a case where the image formation speed is low is selected even if the image formation speed is high. If the device detects that an image to be output includes line images, a first transfer condition may be changed in accordance with an increase in the image formation speed, as described in this exemplary embodiment.

Fourth Exemplary Embodiment

Figure 19:
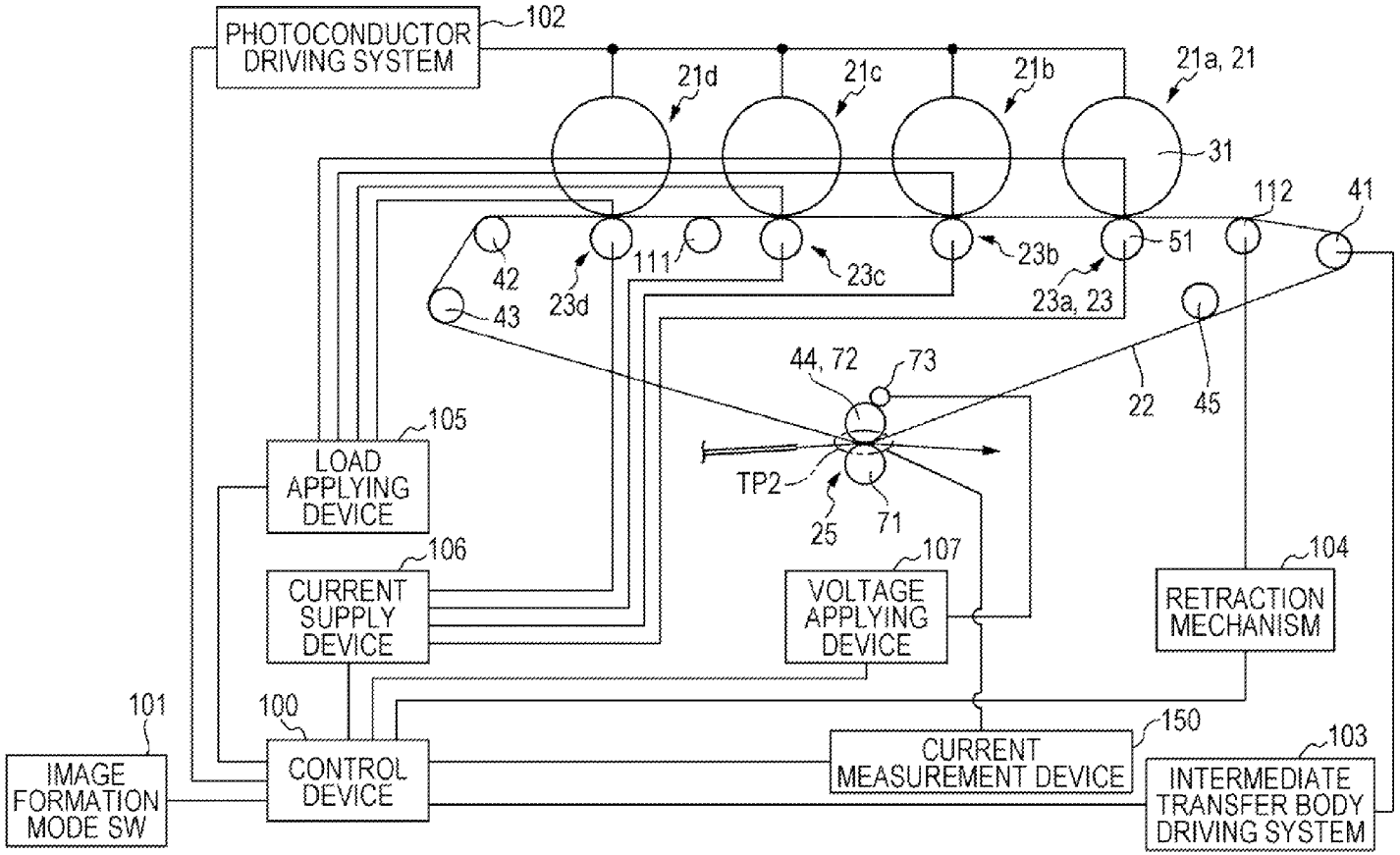
FIG. 19 is an explanatory diagram illustrating a drive control system of an image forming apparatus according to a fourth exemplary embodiment.

FIG. 19 is an explanatory diagram illustrating a part of an image forming apparatus according to a fourth exemplary embodiment.

Referring to FIG. 19, the basic configuration of the image forming apparatus is substantially similar to that in the first exemplary embodiment. However, unlike in the first exemplary embodiment, a combined resistance in the second transfer region TP2 is measured, and a first transfer condition is adjusted in view of the measurement result. The same elements as those in the first exemplary embodiment are denoted by the same reference numerals, and the detailed description thereof is omitted.

In the fourth exemplary embodiment, a current measurement device 150 for measuring a current flowing through the second transfer region TP2 is provided in the second transfer region TP2. The control device 100 measures a combined resistance in the second transfer region TP2 on the basis of the measurement result generated by the current measurement device 150, and sets a first transfer condition using information about the combined resistance.

Here, the combined resistance in the second transfer region TP2 is the sum of resistances in a nip region in a system that is formed of the second transfer roller 71, the intermediate transfer body 22, and the tension roller 44 also functioning as an opposed roller (system resistance). In this exemplary embodiment, the control device 100 causes the voltage applying device 107 to apply a predetermined measurement voltage (it may be sufficiently lower than the second transfer voltage) for measuring the combined resistance in the second transfer region TP2 via the power feed roller 73, causes the current measurement device 150 to measure a current, and calculates the combined resistance in the second transfer region TP2 on the basis of the applied voltage and the measured current.

Figure 20:
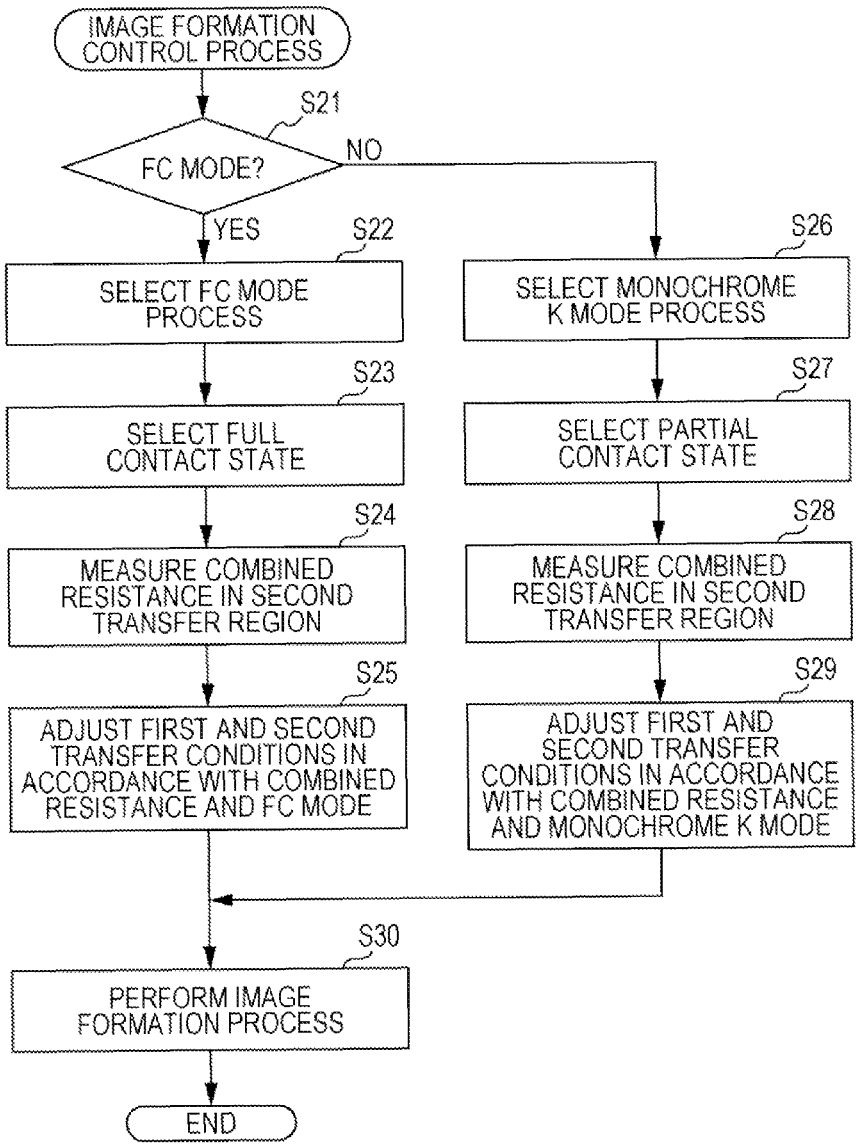
FIG. 20 is a flowchart illustrating a procedure of an image formation control process performed by the image forming apparatus according to the fourth exemplary embodiment.

FIG. 20 is a flowchart illustrating a procedure of an image formation control process performed by the image forming apparatus according to the fourth exemplary embodiment.

Referring to FIG. 20, a user is capable of specifying the FC mode or the monochrome K mode by operating the image formation mode SW 101 illustrated in FIG. 19.

FC Mode

Upon the FC mode being specified as an image formation mode, the control device 100 determines that the image formation mode is the FC mode (YES in step S21 in FIG. 20), and selects an FC mode process in step S22. Also, the control device 100 selects a full contact state (see FIG. 8A) using the retraction mechanism 104 in step S23, and measures a combined resistance in the second transfer region TP2 in step S24.

Subsequently, the control device 100 adjusts a first transfer condition and a second transfer condition in accordance with the combined resistance in the second transfer region TP2 and the FC mode in step S25.

In this exemplary embodiment, the control device 100 sets, as the first transfer condition for each of the first transfer devices 23 (23*a* to 23*d*) of the image forming units 21 (21*a* to 21*d*), loads and first transfer currents in the first transfer regions. Furthermore, the control device 100 sets, as the second transfer condition for the second transfer device 25, a second transfer voltage that enables second transfer.

After setting the first transfer condition and the second transfer condition, the control device 100 performs a series of image formation processes corresponding to the FC mode in step S30.

Monochrome K Mode

Upon the monochrome K mode being specified as an image formation mode, the control device 100 determines that the image formation mode is the monochrome K mode (NO in step S21 in FIG. 20), selects a monochrome K mode process in step S26, selects a partial contact state (see FIG. 5B) using the retraction mechanism 104 in step S27, and measures a combined resistance in the second transfer region TP2 in step S28.

Subsequently, the control device 100 adjusts a first transfer condition and a second transfer condition in accordance with the combined resistance in the second transfer region TP2 and the monochrome K mode in step S29.

In this exemplary embodiment, the control device 100 sets, as the first transfer condition for the first transfer device 23*d* of the image forming unit 21*d*, a load and a first transfer current in the first transfer region. Furthermore, the control device 100 sets, as the second transfer condition for the second transfer device 25, a second transfer voltage that enables second transfer.

After setting the first transfer condition and the second transfer condition, the control device 100 performs a series of image formation processes corresponding to the monochrome K mode in step S30.

Relationship Between Combined Resistance in Second Transfer Region and First Transfer Condition If a combined resistance in the second transfer region TP2 is changed in accordance with a usage history or change in environment, a second transfer condition is changed.

Figure 21A:
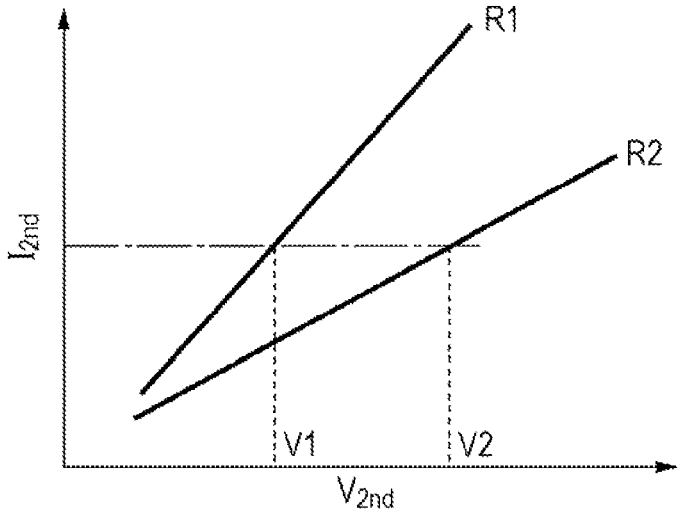
FIG. 21A is an explanatory diagram illustrating changes in second transfer voltage caused by changes in resistance in a second transfer region of the image forming apparatus according to the fourth exemplary embodiment.

For example, as illustrated in FIG. 21A, it is assumed that, when a combined resistance in the second transfer region TP2 is R1, a voltage V1 is necessary as a second transfer voltage $V_{2nd}$ to obtain a predetermined second transfer current $I_{2nd}$. If the combined resistance in the second transfer region TP2 is changed to R2 (>R1), a voltage V2 (>V1) is necessary as the second transfer voltage $V_{2nd}$ to obtain the predetermined second transfer current $I_{2nd}$.

Figure 21B:
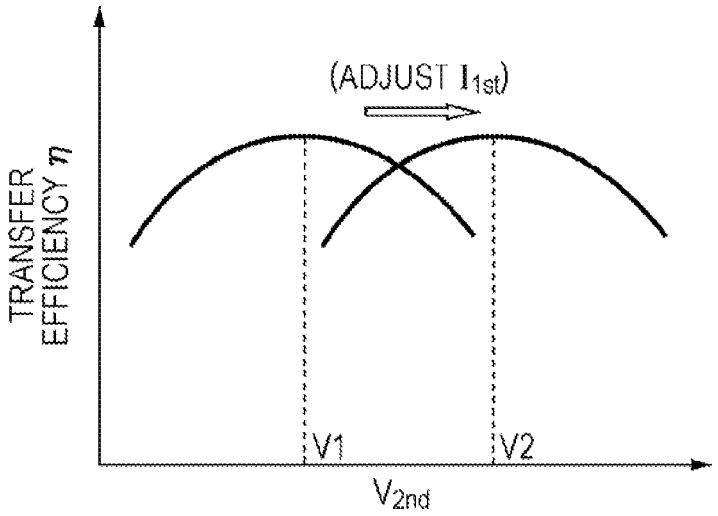
FIG. 21B is an explanatory diagram illustrating the relationship between a second transfer voltage and transfer efficiency in the image forming apparatus according to the fourth exemplary embodiment.

At this time, as illustrated in FIG. 21B, in a case where the voltage V1 is set as the second transfer voltage $V_{2nd}$, a transfer efficiency η of a first transfer toner image is changed around the second transfer voltage V1. In a case where the voltage V2 is set as the second transfer voltage $V_{2nd}$, the transfer efficiency η of the first transfer toner image is changed around the second transfer voltage V2. Thus, when a combined resistance in the second transfer region TP2 is measured, when the second transfer voltage $V_{2nd}$ that is necessary to perform constant current control is to be applied, it is necessary to keep an appropriate transfer efficiency η with respect to the second transfer voltage $V_{2nd}$ to be applied by adjusting a charging characteristic (for example, the amount of charge injected by the first transfer current $I_{1st}$) for the first transfer toner image.

For example, if the combined resistance in the second transfer region TP2 is changed to be increased from R1 to R2, the second transfer voltage $V_{2nd}$ is increased accordingly. In this case, the first transfer current $I_{1st}$ may be adjusted to be higher than before change, so as to increase the amount of charge of the first transfer toner image.

On the other hand, if the combined resistance in the second transfer region TP2 is changed to be decreased, the second transfer voltage $V_{2nd}$ is decreased accordingly. In this case, the first transfer current $I_{1st}$ may be adjusted to be lower than before change, so as to decrease the amount of charge of the first transfer toner image.

A specific example of this exemplary embodiment will be described below.

In this specific example, a combined resistance in the second transfer region is measured, and a first transfer condition is adjusted in accordance with the measurement result.

For example, the first transfer condition is adjusted in the following manner.

<Case 1>

Combined resistance in second transfer region: 25 MΩ

Second transfer voltage: 2.2 kV

Second transfer current: 90 μA

First transfer current: $I_Y=I_M=I_C=45$ μA, $I_K=30$ μA

<Case 2>

Combined resistance in second transfer region: 20 MΩ

Second transfer voltage: 1.8 kV

Second transfer current: 90 μA

First transfer current: $I_Y=I_M=I_C=48$ μA, $I_K=33$ μA

In this example, as in cases 1 and 2, even if the combined resistance in the second transfer region is changed, adjusting first transfer currents in accordance with the change suppresses discharging or charge injection that are unnecessary for charging balance for images of individual colors in the first transfer regions. Thus, even if the second transfer condition is changed due to environment or the like, the first transfer condition is adjustable in view of the change, and degradation in image quality caused by unnecessary discharging or the like does not occur in the second transfer region.

Fifth Exemplary Embodiment

Figure 22:
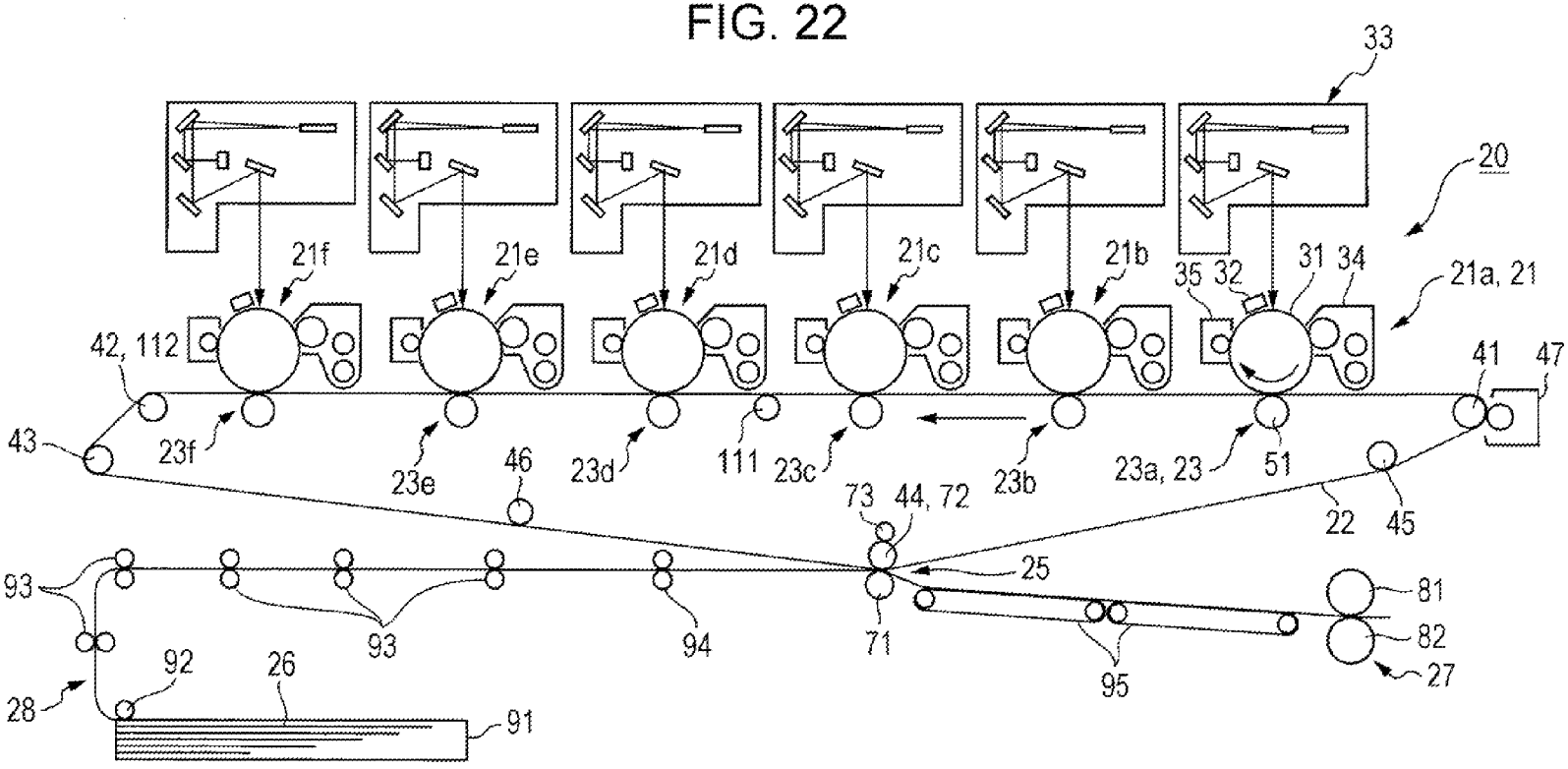
FIG. 22 is an explanatory diagram illustrating the entire configuration of an image forming apparatus according to a fifth exemplary embodiment.

FIG. 22 illustrates the entire configuration of an image forming apparatus according to a fifth exemplary embodiment.

Entire Configuration of Image Forming Apparatus

Referring to FIG. 22, the basic configuration of the image forming apparatus is substantially similar to that in the second exemplary embodiment. However, the number and configuration of the image forming units 21 (21*a* to 21*f*), and the position of the retraction mechanism (not illustrated) are different from those in the second exemplary embodiment, and an image formation mode and a first transfer condition are changed accordingly. The same elements as those in the second exemplary embodiment are denoted by the same reference numerals, and the detailed description thereof is omitted.

Figure 23A:
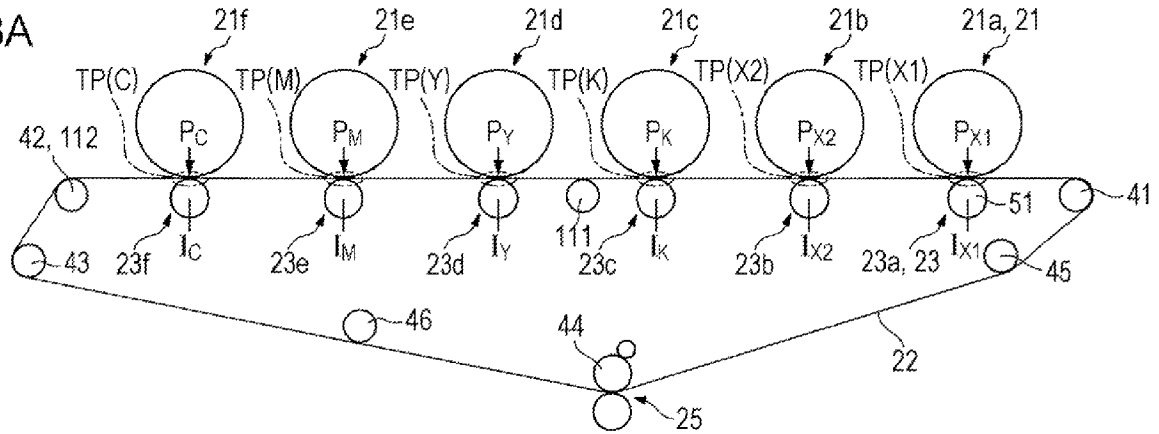
FIG. 23A is an explanatory diagram illustrating an operation state in the FC mode of the image forming apparatus according to the fifth exemplary embodiment.
Figure 23B:
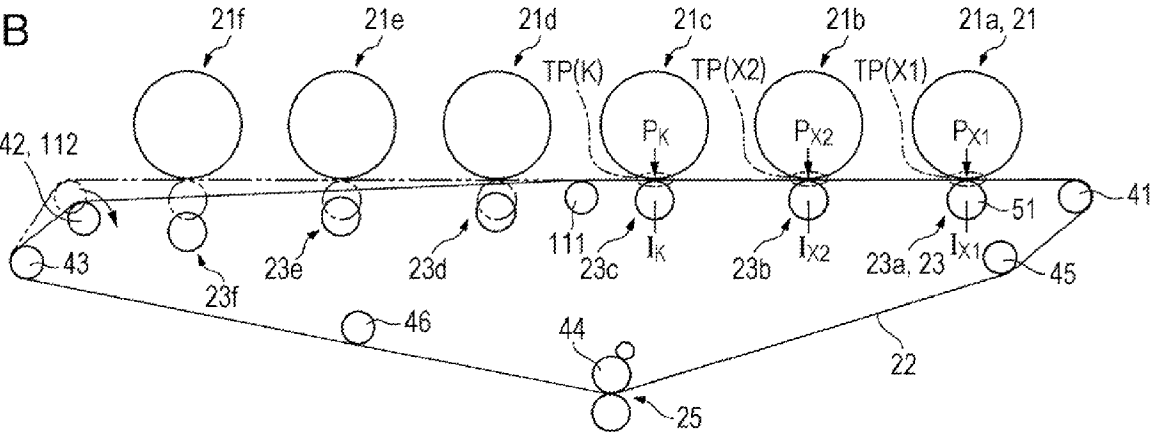
FIG. 23B is an explanatory diagram illustrating an operation state in the monochrome K mode or an extra color mode of the image forming apparatus according to the fifth exemplary embodiment.

In the fifth exemplary embodiment, as illustrated in FIGS. 23A and 23B, the image forming units 21 (21*a* to 21*f*) are arranged in the order of extra color 1 ($X_1$), which is a first extra color, extra color 2 ($X_2$), which is a second extra color, K, Y, M, and C from the upstream side in the movement direction of the intermediate transfer body 22, unlike in the second exemplary embodiment. The intermediate transfer body 22 is rotatably disposed around plural tension rollers 41 to 46.

Further, unlike in the second exemplary embodiment, the retraction mechanism according to the fifth exemplary embodiment (not illustrated) is provided to correspond to the image forming units 21 (21*d* to 21*f*) other than the three image forming units 21 (21*a* to 21*c*) for colors $X_1$, $X_2$, and K on the upstream side in the movement direction of the intermediate transfer body 22, and causes the intermediate transfer body 22 to be in contact with or separated from the photoconductors 31 of the image forming units 21 (21*d* to 21*f*) in accordance with the FC mode, the monochrome K mode, or an extra color mode. In this exemplary embodiment, the retraction mechanism causes the first transfer rollers 51 of the first transfer devices 23 corresponding to the image forming units 21 (21*d* to 21*f*) to be separated from the intermediate transfer body 22 when causing the intermediate transfer body 22 to be separated from the photoconductors 31 of the image forming units 21 (21*d* to 21*f*). The configuration of the retraction mechanism is substantially similar to that in the second exemplary embodiment.

In the fifth exemplary embodiment, the retraction mechanism selects a full contact state in which all the image forming units 21 (21*a* to 21*f*) are in contact with the intermediate transfer body 22 in the FC mode. In the monochrome K mode or the extra color mode, the retraction mechanism selects a partial contact state in which the image forming units 21 (21*a* to 21*c*) are in contact with the intermediate transfer body 22.

Control System of Image Forming Apparatus

Figure 24:
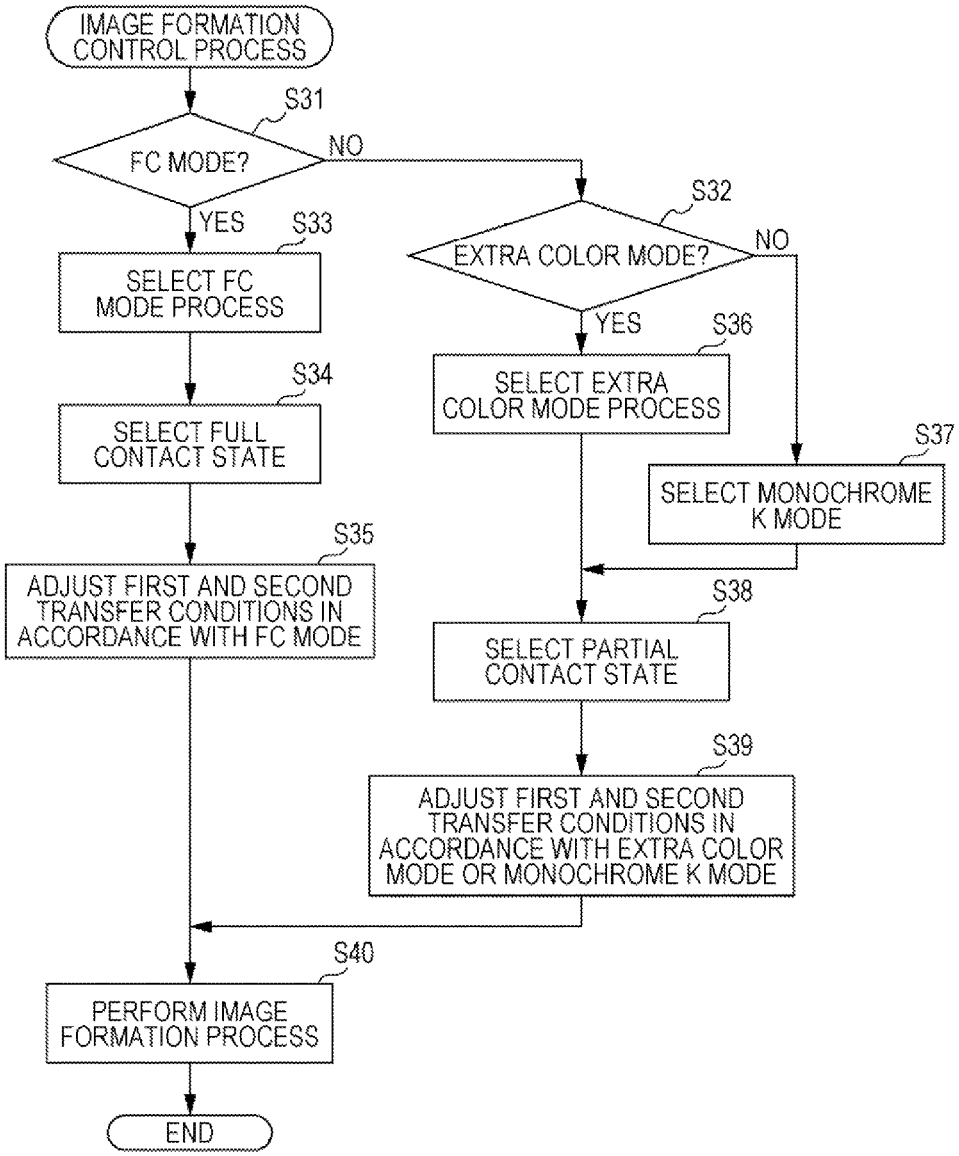
FIG. 24 is a flowchart illustrating a procedure of an image formation control process performed by the image forming apparatus according to the fifth exemplary embodiment.

FIG. 24 is flowchart illustrating a procedure of an image formation control process performed by the image forming apparatus according to the fifth exemplary embodiment.

Referring to FIG. 24, a user is capable of specifying the FC mode, the monochrome K mode, or the extra color mode by operating an image formation mode SW (not illustrated), which correspond to the image formation mode SW 101 illustrated in FIG. 4.

FC Mode

Upon the FC mode being specified as an image formation mode, the control device 100 determines that the image formation mode is the FC mode (YES in step S31 in FIG. 24), and selects an FC mode process in step S33. Also, the control device 100 selects a full contact state (see FIG. 23A) using the retraction mechanism (not illustrated) in step S34.

Subsequently, the control device 100 adjusts a first transfer condition and a second transfer condition in accordance with the FC mode in step S35.

In this exemplary embodiment, the control device 100 sets, as the first transfer condition for each of the first transfer devices 23 (23*a* to 23*f*) of the image forming units 21 (21*a* to 21*f*, loads and first transfer currents in the first transfer regions. Furthermore, the control device 100 sets, as the second transfer condition for the second transfer device 25, a second transfer voltage that enables second transfer. After setting the first transfer condition and the second transfer condition, the control device 100 performs a series of image formation processes corresponding to the FC mode in step S40.

Monochrome K Mode

Upon the monochrome K mode being specified as an image formation mode, the control device 100 determines that the image formation mode is the monochrome K mode (NO in steps S31 and S32 in FIG. 24), selects a monochrome K mode process in step S37, and selects a partial contact state (see FIG. 23) using the retraction mechanism (not illustrated) in step S38.

Subsequently, the control device 100 adjusts a first transfer condition and a second transfer condition in accordance with the monochrome K mode in step S39.

In this exemplary embodiment, the control device 100 sets, as the first transfer condition for each of the first transfer devices 23 (32*a* to 23*c*) of the image forming units 21 (21*a* to 21*c*), loads and first transfer currents in the first transfer regions. Furthermore, the control device 100 sets, as the second transfer condition for the second transfer device 25, a second transfer voltage that enables second transfer. After setting the first transfer condition and the second transfer condition, the control device 100 performs a series of image formation processes corresponding to the monochrome K mode in step S40.

In this exemplary embodiment, the image forming units 21 (21*a* to 21*c*) for colors $X_1$, $X_2$, and K are in contact with the intermediate transfer body 22. In the monochrome K mode, only the image forming unit 21*c* for color K performs a substantial image formation process, whereas the image forming units 21*a* and 21*b* for extra colors $X_1$ and $X_2$ idle along the intermediate transfer body 22 and do not perform a substantial image formation process.

Extra Color Mode

Upon the extra color mode being specified as an image formation mode, the control device 100 determines that the image formation mode is the extra color mode (YES in step S32 in FIG. 24), selects an extra color mode process in step S36, and selects a partial contact state (see FIG. 23B) using the retraction mechanism (not illustrated) in step S38.

Subsequently, the control device 100 adjusts a first transfer condition and a second transfer condition in accordance with the extra color mode in step S39.

In this exemplary embodiment, the control device 100 sets, as the first transfer condition for each of the first transfer devices 23 (23*a* to 23*c*) of the image forming units 21 (21*a* to 21*c*), loads and first transfer currents in the first transfer regions. Furthermore, the control device 100 sets, as the second transfer condition for the second transfer device 25, a second transfer voltage that enables second transfer. After setting the first transfer condition and the second transfer condition, the control device 100 performs a series of image formation processes corresponding to the extra color mode in step S40.

In this exemplary embodiment, the image forming units 21 (21*a* to 21*c*) for colors $X_1$, $X_2$, and K are in contact with the intermediate transfer body 22. In the extra color mode, the image forming units 21*a* and 21*b* for extra colors $X_1$ and $X_2$ perform a substantial image formation process, whereas the image forming unit 21*c* for color K idles along the intermediate transfer body 22 and does not perform a substantial image formation process.

Adjustment of First Transfer Condition

In the fifth exemplary embodiment, a first transfer condition is set in accordance with the FC mode, the monochrome K mode, or the extra color mode, as illustrated in FIGS. 23A, 23B, 24, and 25A.

In FIGS. 23A, 23B, 25A, and 25B, the loads in the first transfer regions TP1 (specifically, TP(X1) to TP(K)) of the individual image forming units 21 are represented by P (specifically, $P_{X1}$ to $P_K$), and the first transfer currents in the first transfer regions TP1 are represented by I (specifically, $I_{X1}$ to $I_K$).

FC Mode

A first transfer condition in the FC mode is set as illustrated in FIG. 25A.

That is, regarding the loads P in the first transfer regions TP1, the load $P_C$ in the first transfer region TP(C) of the image forming unit 21*f* (for color C in this exemplary embodiment) at the most downstream position in the movement direction of the intermediate transfer body 22 may be set to be higher than any of the loads $P_{X1}$ to $P_M$ in the first transfer regions TP(X1) to TP(M) of the image forming units 21*a* to 21*e* (for colors $X_1$, $X_2$, K, Y, and M in this exemplary embodiment) on the upstream side. The loads $P_{X1}$ to $P_M$ may be equal to one another, or may be set so that the load in the image forming unit 21 on a downstream side is higher than that in the image forming unit 21 on an upstream side.

Regarding the first transfer currents I, the first transfer current $I_C$ in the first transfer region TP(C) of the image forming unit 21*f* (for color C in this exemplary embodiment) at the most downstream position in the movement direction of the intermediate transfer body 22 may be set to be lower than any of the first transfer currents $I_{X1}$ to $I_M$ in the first transfer regions TP(X1) to TP(M) of the image forming units 21*a* to 21*e* (for colors $X_1$, $X_2$, K, Y, and M in this exemplary embodiment) on the upstream side. The first transfer currents $I_{X1}$ to $I_M$ may be equal to one another, or may be set so that the first transfer current in the image forming unit 21 on a downstream side is lower than that in the image forming unit 21 on an upstream side.

Monochrome K Mode

A first transfer condition in the monochrome K mode is set as illustrated in FIG. 25A.

That is, regarding the load P in the first transfer region TP1, the load $P_K$ in the first transfer region TP(K) of the image forming unit 21*c* for color K needs to be set to be at least higher than the load $P_K$ in the FC mode (represented by "$P_K$(FC mode)"). For example, in a case where the image formation speed in the monochrome K mode is higher than the image formation speed in the FC mode, it is desired that the load $P_K$ be set to be higher than the load $P_C$(FC mode) in the image forming unit 21*f* (for color C in this exemplary embodiment) at the most downstream position.

Regarding the first transfer current I, the first transfer current $I_K$ in the first transfer region TP(K) of the image forming unit 21*c* for color K need to be set to be at least lower than the first transfer current $I_K$ in the FC mode (represented by "$I_K$(FC mode)"). For example, in a case where the image formation speed in the monochrome K mode is higher than the image formation speed in the FC mode, and where the load $P_K$ in the first transfer region TP(K) is set to be higher than any of the loads in the other first transfer regions, it is desired that the first transfer current $I_K$ be set to be lower than the first transfer current $I_C$(FC mode) in the image forming unit 21*f* (for color C in this exemplary embodiment) at the most downstream position.

Extra Color Mode

A first transfer condition in the extra color mode is set as illustrated in FIG. 25A.

That is, regarding the loads P in the first transfer regions, it is necessary that the loads $P_{X1}$ and $P_{X2}$ in the first transfer regions TP(X1) and TP(X2) of the image forming units 21 (21*a* and 21*b*) for extra colors be set so that the load $P_{X2}$ on the downstream side is higher than the load $P_{X1}$ on the upstream side and that the loads $P_{X1}$ and $P_{X2}$ are at least higher than the load $P_{X1}$ in the FC mode ("$P_{X1}$ (FC mode)"). In a case where the image formation speed in the extra color mode is higher than the image formation speed in the FC mode, it is desirable that the loads $P_{X1}$ and $P_{X2}$ be set to be higher than the load $P_C$(FC mode) in the first transfer region of the image forming unit 21*f* (for color C in this exemplary embodiment) at the most downstream position.

Regarding the first transfer currents I, it is necessary that the first transfer currents $I_{X1}$ and $I_{X2}$ in the first transfer regions TP(X1) and TP(X2) of the image forming units 21*a* and 21*b* for extra colors be set so that the first transfer current $I_{X2}$ on the downstream side is lower than the first transfer current $I_{X1}$ on the upstream side and that the first transfer currents $I_{X1}$ and $I_{X2}$ are at least lower than the first transfer current $I_{X1}$ in the FC mode ("$I_{X1}$ (FC mode)"). For example, in a case where the image formation speed in the extra color mode is higher than the image formation speed in the FC mode, and where the load in the first transfer region TP(K) is set to be higher than the load in any other first transfer region, it is desirable that the first transfer currents $I_{X1}$ and $I_{X2}$ be set to be lower than the first transfer current $I_C$(FC mode) of the image forming unit 21*f* (for color C in this exemplary embodiment) on the most downstream side.

As described above, in the fifth exemplary embodiment, when the FC modes is selected, a full contact state is employed in which the retraction mechanism (not illustrated) causes all the image forming units 21 (21*a* to 21*f*) to be in contact with the intermediate transfer body 22, as illustrated in FIG. 23A, and the above-described first transfer condition is satisfied. Thus, substantially similarly to the second exemplary embodiment, even if a first transfer toner image includes plural line images, the occurrence of toner scattering in a portion of a line image caused by a fluid force generated by compressed air in a gap between line images may be suppressed. Furthermore, insufficient density of a second transfer image resulting from unnecessary discharging or unnecessary charge injection to a first transfer toner image may be effectively avoided.

When the monochrome K mode or the extra color mode is selected, a partial contact state is employed in which the retraction mechanism (not illustrated) causes some image forming units 21 (21*a* to 21*c* in this exemplary embodiment) to be in contact with the intermediate transfer body 22, as illustrated in FIG. 23B, and the above-described first transfer condition is satisfied. Thus, substantially similarly to the second exemplary embodiment, even if a first transfer toner image of color K or an extra color includes plural line images, the occurrence of toner scattering in a portion of a line image caused by a fluid force generated by compressed air in a gap between line images may be suppressed. Furthermore, insufficient density of a second transfer image resulting from unnecessary discharging or unnecessary charge injection to a first transfer toner image may be effectively avoided.

Modification of Fifth Exemplary Embodiment

In the fifth exemplary embodiment, the image forming units 21 are arranged in the order of the first extra color ($X_1$), the second extra color ($X_2$), K, Y, M, and C, and a first transfer condition is set in accordance with an image formation mode. Alternatively, in the fifth exemplary embodiment, the features of the third exemplary embodiment (switching between image formation speeds) or the fourth exemplary embodiment (change in combined resistance in the second transfer region is taken into consideration) may be added.

In the fifth exemplary embodiment, when the FC mode is selected, the load Pc in the first transfer region of the image forming unit 21*f* (for color C in this exemplary embodiment) at the most downstream position is set to be higher than the load in any other first transfer region, and the first transfer current $I_C$ is set to be lower than the first transfer current in any other first transfer region. In the case of forming plural line images in a C toner image formed by the image forming unit 21*f* at the most downstream position or an M toner image formed by the image forming unit 21*e* in the preceding stage, if toner scattering is not remarkable, the first transfer condition for the image forming unit 21*f* at the most downstream position may be set to be equivalent to the first transfer condition for the image forming unit 21*e* (for color M in this exemplary embodiment), as illustrated in FIG. 25B.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of image carriers each of which carries a toner image that is formed thereon;

an intermediate transfer body that is rotated while facing the image carriers, is disposed so as to be in contact with one or more image carriers among the image carriers, and carries one or more toner images formed on the one or more image carriers;

a contact and separation mechanism that causes the intermediate transfer body to be in contact with or separated from the image carriers;

a selection member that selects, using the contact and separation mechanism, a first contact state in which all of the image carriers and the intermediate transfer body are in contact with each other or a second contact state in which one or some of the image carriers and the intermediate transfer body are in contact with each other;

a plurality of first transfer units each of which includes a transfer member that corresponds to one image carrier among the image carriers and that is in contact with a back surface of the intermediate transfer body, and each of which forms a transfer electric field in a first transfer region between the transfer member and the one image carrier to transfer a toner image onto the intermediate transfer body;

a second transfer unit that includes a transfer member disposed so as to face the intermediate transfer body and that forms an electric field in a second transfer region between the transfer member and the intermediate transfer body to transfer toner images that have been transferred onto the intermediate transfer body onto a recording material; and an adjustment member that adjusts first transfer conditions for the first transfer units, wherein the adjustment member includes a load adjustment unit that adjusts a load of at least a downstream first transfer unit corresponding to the image carrier located at a most downstream position in a movement direction of the intermediate transfer body among the one or more image carriers used for image formation so that when the selection member selects the second contact state, (1) the load in the first transfer region of the transfer member of the downstream first transfer unit that is in contact with the intermediate transfer body is set to be higher than when the first contact state is selected, and so that, (2) when there is an upstream first transfer unit that is in contact with the intermediate transfer body located on an upstream side of the downstream first transfer unit in the movement direction of the intermediate transfer body, the load of the downstream first transfer unit is set to be higher than a load in the upstream first transfer unit.

2. The image forming apparatus according to claim 1, wherein the adjustment member includes a load adjustment unit that adjusts, when the selection member selects the second contact state, a load of a selected first transfer unit in the first transfer region of the transfer member that is in contact with the intermediate transfer body is set to be equal to or higher than the load of the selected first transfer unit in the first contact state, the selected first transfer unit being one of the plurality of first transfer units other than the downstream first transfer unit.

3. The image forming apparatus according to claim 2, wherein the adjustment member includes an electric field adjustment unit that adjusts, when the selection member selects the second contact state, (1) a transfer electric field that acts on the first transfer region of the transfer member of the downstream first transfer unit so that the transfer electric field is set to be lower than when the first contact state is selected, and so that, (2) when there is an upstream first transfer unit that is in contact with the intermediate transfer body located on the upstream side in the movement direction of the intermediate transfer body, the transfer electric field of the downstream first transfer unit is set to be lower than a transfer electric field in the upstream first transfer unit.

4. The image forming apparatus according to claim 3, wherein the adjustment member includes an electric field adjustment unit that adjusts, when the selection member selects the second contact state, a transfer electric field that acts on the first transfer region of the transfer member of a selected first transfer unit so that the transfer electric field of the selected first transfer unit is set to be equal to or lower than when the first contact state is selected, the selected first transfer unit being one of the plurality of first transfer units other than the downstream first transfer unit.

5. The image forming apparatus according to claim 4, further comprising:

a resistance measurement device that is capable of measuring a combined resistance of at least the second transfer unit and the intermediate transfer body in the second transfer region of the second transfer unit, wherein the adjustment member includes an electric field adjustment unit that adjusts, for one or more first transfer units corresponding to the one or more image carriers used for image formation, in accordance with the combined resistance in the second transfer region measured by the resistance measurement device, a transfer electric field that acts on the first transfer region of the transfer member that is in contact with the intermediate transfer body so that the transfer electric field becomes higher when the combined resistance is changed to be decreased.

6. The image forming apparatus according to claim 3, further comprising:

a resistance measurement device that is capable of measuring a combined resistance of at least the second transfer unit and the intermediate transfer body in the second transfer region of the second transfer unit, wherein the adjustment member includes an electric field adjustment unit that adjusts, for one or more first transfer units corresponding to the one or more image carriers used for image formation, in accordance with the combined resistance in the second transfer region measured by the resistance measurement device, a transfer electric field that acts on the first transfer region of the transfer member that is in contact with the intermediate transfer body so that the transfer electric field becomes higher when the combined resistance is changed to be decreased.

7. The image forming apparatus according to claim 1, wherein the adjustment member includes an electric field adjustment unit that adjusts, when the selection member selects the second contact state, (1) a transfer electric field that acts on the first transfer region of the transfer member of the downstream first transfer unit so that the transfer electric field is set to be lower than when the first contact state is selected, and so that, (2) when there is an upstream first transfer unit that is in contact with the intermediate transfer body located on the upstream side in the movement direction of the intermediate transfer body, the transfer electric field of the downstream first transfer unit is set to be lower than a transfer electric field in the upstream first transfer unit.

8. The image forming apparatus according to claim 7, wherein the adjustment member includes an electric field adjustment unit that adjusts, when the selection member selects the second contact state, a transfer electric field that acts on the first transfer region of the transfer member of a selected first transfer unit so that the transfer electric field of the selected first transfer unit is set to be equal to or lower than when the first contact state is selected, the selected first transfer unit being one of the plurality of first transfer units other than the downstream first transfer unit.

9. The image forming apparatus according to claim 8, further comprising:

a resistance measurement device that is capable of measuring a combined resistance of at least the second transfer unit and the intermediate transfer body in the second transfer region of the second transfer unit, wherein the adjustment member includes an electric field adjustment unit that adjusts, for one or more first transfer units corresponding to the one or more image carriers used for image formation, in accordance with the combined resistance in the second transfer region measured by the resistance measurement device, a transfer electric field that acts on the first transfer region of the transfer member that is in contact with the intermediate transfer body so that the transfer electric field becomes higher when the combined resistance is changed to be decreased.

10. The image forming apparatus according to claim 7, further comprising:

a resistance measurement device that is capable of measuring a combined resistance of at least the second transfer unit and the intermediate transfer body in the second transfer region of the second transfer unit, wherein the adjustment member includes an electric field adjustment unit that adjusts, for one or more first transfer units corresponding to the one or more image carriers used for image formation, in accordance with the combined resistance in the second transfer region measured by the resistance measurement device, a transfer electric field that acts on the first transfer region of the transfer member that is in contact with the intermediate transfer body so that the transfer electric field becomes higher when the combined resistance is changed to be decreased.

* * * * *